US005089235A

United States Patent [19]

Schwartz et al.

[11] Patent Number: 5,089,235

[45] Date of Patent: Feb. 18, 1992

[54] CATALYTIC CRACKING UNIT WITH EXTERNAL CYCLONE AND OIL QUENCH SYSTEM

[75] Inventors: John G. Schwartz; F. William Hauschildt, both of Naperville; George E. Quinn, Winfield; John M. Forgac, Elmhurst, all of Ill.

[73] Assignee: Amoco Corporation, Chicago, Ill.

[21] Appl. No.: 499,044

[22] Filed: Mar. 26, 1990

[51] Int. Cl.[5] ..... F27B 15/12; F27B 15/14; F27B 15/16; B01J 8/18

[52] U.S. Cl. ..... 422/144; 208/48 Q; 422/145; 422/146; 422/147

[58] Field of Search ..... 422/144, 145, 146, 147; 208/48 Q, 113, 150, 153, 159, 163

[56] References Cited

U.S. PATENT DOCUMENTS

| | | | |
|---|---|---|---|
| 2,458,862 | 1/1949 | Krebs | 260/683.3 |
| 2,793,171 | 5/1957 | Fritz | 202/14 |
| 2,859,168 | 11/1958 | Downing et al. | 208/48 |
| 2,874,113 | 2/1959 | Smith et al. | 422/ |
| 2,889,265 | 6/1959 | Borey et al. | 208/100 |
| 2,906,695 | 9/1959 | Boston | 208/127 |
| 2,943,994 | 7/1960 | McCain | 208/48 |
| 3,174,924 | 3/1965 | Clark et al. | 208/48 Q |
| 3,175,966 | 3/1965 | Burch | 208/79 |
| 3,322,647 | 5/1967 | Calaway | 208/48 Q |
| 3,338,821 | 8/1967 | Moyer et al. | 208/48 Q X |
| 3,355,380 | 11/1967 | Luckenbach | 208/153 |
| 3,440,163 | 5/1969 | Hamner | 208/40 |
| 3,593,968 | 7/1971 | Geddes | 261/118 |
| 3,785,782 | 1/1974 | Cartmell | 23/288 S |
| 4,043,899 | 8/1977 | Anderson et al. | 208/161 |
| 4,049,540 | 9/1977 | Ueda et al. | 208/127 |
| 4,061,562 | 12/1977 | McKinney et al. | 208/61 |
| 4,348,364 | 9/1982 | Gartside et al. | 422/147 X |
| 4,756,886 | 7/1988 | Pfeiffer et al. | 422/144 |
| 4,822,761 | 4/1989 | Walters et al. | 502/38 |
| 4,978,440 | 12/1990 | Krambeck et al. | 208/113 |

*Primary Examiner*—Robert J. Warden
*Assistant Examiner*—Amalia Santiago
*Attorney, Agent, or Firm*—Thomas W. Tolpin; William H. Magidson; Ralph C. Medhurst

[57] ABSTRACT

Effective quenching is provided in a catalytic cracking unit to increase product yield and decrease thermal cracking. For increased benefits, the quench is injected at special locations. In the illustrated embodiment, the quench is injected into the oil product immediately downstream of an external gross cut separator before the product enters a disengaging vessel.

9 Claims, 9 Drawing Sheets

LCCO QUENCH
219
218
284
206
220
240
205
222
228
230
208
DISENGAGING VESSEL
242
REGENERATOR
232
200
RISER REACTOR
216
266
217
280
244
268
270
271
246

CATALYTIC CRACKING UNIT WITH EXTERNAL CYCLONE AND OIL QUENCH SYSTEM

BACKGROUND OF THE INVENTION

This invention relates to catalytic cracking and, more particularly, to a catalytic cracking unit.

Catalytic cracking of oil is an important refinery process which is used to produce gasoline and other hydrocarbons. During catalytic cracking, the feedstock, which is generally a cut or fraction of crude oil, is cracked in a reactor under catalytic cracking temperatures and pressures in the presence of a catalyst to produce more valuable, lower molecular weight hydrocarbons. Gas oil is usually used as a feedstock in catalytic cracking. Gas oil feedstocks typically contain from 55% to 80% gas oil by volume having a boiling range from about 650° F. (343° C.) to about 1000° F. (538° C.) and less than 1% RAMS carbon by weight. Gas oil feedstocks also typically contain less than 5% by volume naphtha and lighter hydrocarbons having a boiling temperature below 430° F., from 10% to 30% by volume diesel and kerosene having a boiling range from about 430° F. (221° C.) to about 650° F. (343° C.), and less than 10% by volume resid oil having a boiling temperature above 1000° F. Resid oil is sometimes present in greater concentrations or added to the gas oil feedstock.

In conventional fluid catalytic cracking units (FCCU), the hot products from the riser reactor continue to undergo thermal cracking reactions above 900° F. (482° C.) downstream of the riser reactor. These thermal cracking reactions degrade the products, reduce yields, and make excess light gases which often unduly limit the production capability of the catalytic cracking unit.

Furthermore, while it is often desirable to operate a riser reactor at higher temperatures, such as at 1025° F. (552° C.) or higher, to increase gasoline octane and oil and resid conversion, such high temperature cracking have substantially increased the production of ethane and lighter fuel gas. This dramatic increase of fuel gas production can create an imbalance in the refinery fuel gas system. It may also limit the capacity of those FCCUs which have insufficient gas compression capability to handle the increased load. Therefore, despite incentives for increased gasoline and octane production, riser temperatures have sometimes been reduced.

Operation at higher cracking temperatures produce naphthas which are less stable and are more prone to undergo undesired oxidation reactions which form gums. Prior methods for maintaining the stability of cracked naphthas and for maintaining the stability of gasolines containing cracked naphthas have included: 1) addition of antioxidant chemicals such as phenylene diamines or hindered phenols; 2) manipulation of the operating variables-of the cracking process, such as lowering the cracking temperature and/or limiting the amount of resid; or 3) limiting the amount of cracked naphtha blended into the finished gasoline.

Typifying some of the many prior art catalytic crackers, regenerators, catalysts, equipment and refinery processes are those shown in U.S. Pat. Nos. 2,240,160; 2,382,270; 2,382,382; 2,398,739; 2,398,759; 2,414,002; 2,422,501; 2,425,849; 2,436,927; 2,458,862; 2,669,591; 2,827,422; 2,884,303; 2,901,418; 2,981,676; 2,985,584; 3,004,926; 3,039,953; 3,290,405; 3,338,821; 3,351,548; 3,364,136; 3,513,087; 3,563,911; 3,593,968; 3,661,800; 3,676,519; 3,692,667; 3,838,036; 3,844,973; 3,850,742; 3,886,060; 3,907,661; 3,909,392; 4,043,899; 4,218,300; 4,325,817; 4,331,533; 4,332,674; 4,341,623; 4,341,660; 4,375,021; 4,446,009; 4,478,708; 4,552,645; 4,695,370; 4,764,268; 4,814,067; 4,824,557; 4,859,310; and European Patent Application Nos. 83307095.6 (publication no. EPO 113 180 A2), 85307242.9 (publication no. EPO 180 355 A2), and 88309278.5 (publication no. EPO 311 375 A1). These prior art catalytic crackers, regenreators, catalysts, equipment, and refinery processes have met with varying degrees of success.

It is, therefore, desirable to provide an improved process to increase the yield of gasoline (naphtha) in catalytic cracking units and which improves the stability of gasoline (petrol) which contain these naphthas.

SUMMARY OF THE INVENTION

An improved catalytic cracking process and unit are provided which are effective, efficient, and economically attractive.

The novel catalytic cracking process and unit comprises catalytically cracking feed oil, such as gas oil, hydrotreated oil, and/or resid oil, in a reactor of a catalytic cracking unit (FCCU) in the presence of a cracking catalyst to produce a catalytically cracked, effluent product stream of upgraded oil and, after catalytic cracking is substantially completed, quenching the product stream externally and downstream of the reactor with a quench line or injector after the catalytically cracked oil has exited and been discharged from the reactor, to increase the yield of naphtha and gasoline (petrol) produce more stable gasoline. Rapid quenching also attains a desirable shift in coke make and selectivity.

Preferably, the quench has a volumetric expansion on vaporization substantially less than water and steam. In the preferred form, the quench comprises a hydrocarbon stream which has been previously cracked or otherwise processed to remove the most reactive species. Desirably, the quench should have low thermal reactivity. Previously cracked hydrocarbons are very desirable because they are less reative to thermal quenching than fresh unprocessed virgin feedstocks and hydrotreated stocks.

To this end, the quench can comprise kerosene, light coker gas oil, coke still (coker) distillates (CSD), hydrotreated distillate, or fresh unprocessed virgin feedstocks, such as virgin gas oil, heavy virgin naphtha, light virgin naphtha, but preferably comprises light catalytic cycle oil (LCCO or LCO), heavy catalytic cycle oil (HCCO or HCO), or heavy catalytic naphtha (HCN), or any combination thereof. LCCO boils at a lower temperature than HCCO but they have about the same heat of vaporization. For best results, the quench comprises LCCO which has a greater molecular weight than water. HCCO, however, is also very useful as a quench and less expensive than LCCO.

Steam and water are generally not desirable as a quench, because they: expand a lot on vaporization, take up a lot of reactor volume, expand in overhead lines, cause pressure disruption, disturb catalyst circulation, adversely affect cyclone operation, and produce substantial quantities of polluted water which have to be purified. Excessive quantities of steam are also required in steam quenching.

Light naphtha (light virgin naphtha, light catalytic naphtha, light coker naphtha, etc.) is also not generally desirable as a quench because it occupies too much volume in the reactor. Furthermore, light naphtha is a gasoline blending product and it is not desirable to crack the light naphtha into less valuable hydrocarbons.

Decanted oil (DCO) is not generally desirable as a quench because it has a tendency to coke. Catalyst in the DCO can also erode the interior reactor walls and lines.

Resid is further not desirable as a quench because it has a tendency to coke and plug up lines..

Liquid hydrocarbon quenches are preferred over gas quenches to attain the benefit of the heat of vaporization of the liquid quench. Desirably, the liquid quench is injected into the product stream in an amount ranging from 2% to 20%, and preferably from 5% to 15% of the volume flow rate of feed oil for best results. Advantageously, quenching decreases the temperature of the product stream and minimizes thermal cracking. Quenching can also increase the conversion of feed oil to upgraded oil and can increase the octane of the gasoline.

Kerosene, coker gas oil, and hydrotreated distillates are less advantageous as a quench than are LCCO and HCCO. Liquid nitrogen can be useful as a quench but is very expensive and has an undesirable volumetric expansion.

LCCO and HCCO have a high capacity to absorb heat, enhance operations, and do not materially increase operating utility, maintenance, and waste treatment costs. LCCO and HCCO provide excellent quenches because they are readily available in refineries, economical, stable, have low volume expansion, provide recoverable heat removal and have a low tendency to form coke. Quenching with cycle oil can decrease the amount of coke produced. Cycle oil quenching also permits high temperature cracking without loss of more valuable hydrocarbons, and without damaging internal cyclones, plenum, or refractory walls. Desirably, cycle oil quenching, substantially decreases fuel gas production.

In the preferred form, the coked catalyst is separated from the upgraded oil by gross separation in a vapor catalyst separator, such as in a rough cut cyclone, and the upgraded oil is immediately quenched to decrease thermal cracking of the upgraded oil to less valuable hydrocarbon products and light hydrocarbon gases. Desirably, the quenching occurs downstream of a riser reactor and the vapor product outlet (exit) of the rough cut cyclone of the catalytic cracking unit. It is more efficient and economical to add the quench to the catalytic cracked oil after gross separation of the catalyst from the oil. Required quench volumes and pumping costs are also decreased.

In one of the illustrated embodiments, quenching occurs upstream of the disengaging and stripping vessel. In one preferred form of this application, the catalytic cracking unit has an external rough cut cyclone positioned between the riser reactor and the disengaging and stripper vessel and the quench is injected immediately downstream of the vapor (product) exit of the external rough cut cyclone.

Advantageously, with quenching, the selectivity of coke can be decreased and less coke can be produced in the dilute phase portion of the disengaging and stripping vessel. Spent coked catalyst is regenerated in a regenerator and is recycled to the riser reactor. Desirably, during the novel quenching process the regeneration temperature of the regenerator is decreased. In the preferred mode, the regenerator is operated in full CO (carbon monoxide) combustion whereby the coked catalyst is regenerated in the presence of a combustion-supporting gas, such as air, comprising excess molecular oxygen in an amount greater than the stoichiometric amount required to completely combust the coke on the coked catalyst to carbon dioxide. The regenerator can also be operated in partial CO burn.

As used in this patent application, the term "conversion" means the relative disappearance of the amount of feed which boils above 430° F. (221° C.).

As used in this application, the term "coke selectivity" means the ratio of coke yield to conversion.

A more detailed explanation is provided in the following description and appended claims taken in conjunction with the accompanying drawings.

DETAILED DESCRIPTION OF THE PREFERRED EMBODIMENTS

Figure 3:
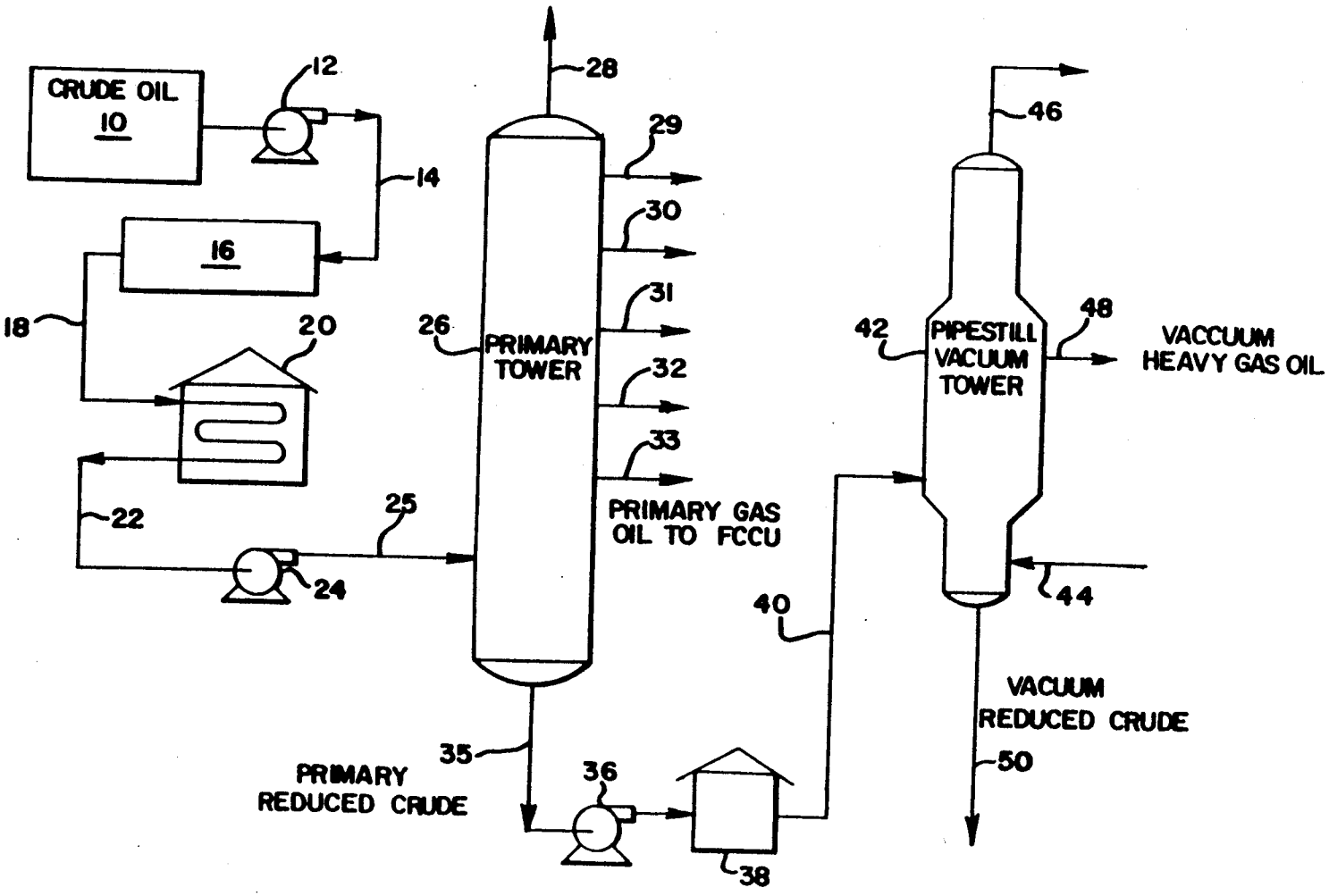
FIG. 3 is a schematic flow diagram of part of an oil refinery.

In refining, unrefined, raw, whole crude oil (petroleum) is withdrawn from an aboveground storage tank 10 (FIG. 3) by a pump 12 and pumped through feed line 14 into one or more desalters 16 to remove particulates, such-as sand, salt, and metals, from the oil. The desalted oil is fed through furnace inlet line 18 into a pipestill furnace 20 where it is heated to a temperature, such as to 750° F. (399° C.) at a pressure ranging from 125 to 200 psi. The heated oil is removed from the furnace through exit line 22 by a pump 24 and pumped through a feed line 25 to a primary distillation tower 26.

The heated oil enters the flash zone of the primary atmospheric distillation tower, pipestill, or crude oil unit 26 before proceeding to its upper rectifier section or the lower stripper section. The primary tower is preferably operated at a pressure less than 60 psi. In the primary tower, the heated oil is separated into fractions of wet gas, light naphtha, intermediate naphtha, heavy naphtha, kerosene, virgin gas oil, and primary reduced crude. A portion of the wet gas, naphtha, and kerosene is preferably refluxed (recycled) back to the primary tower to enhance fractionation and efficiency.

Figure 4:
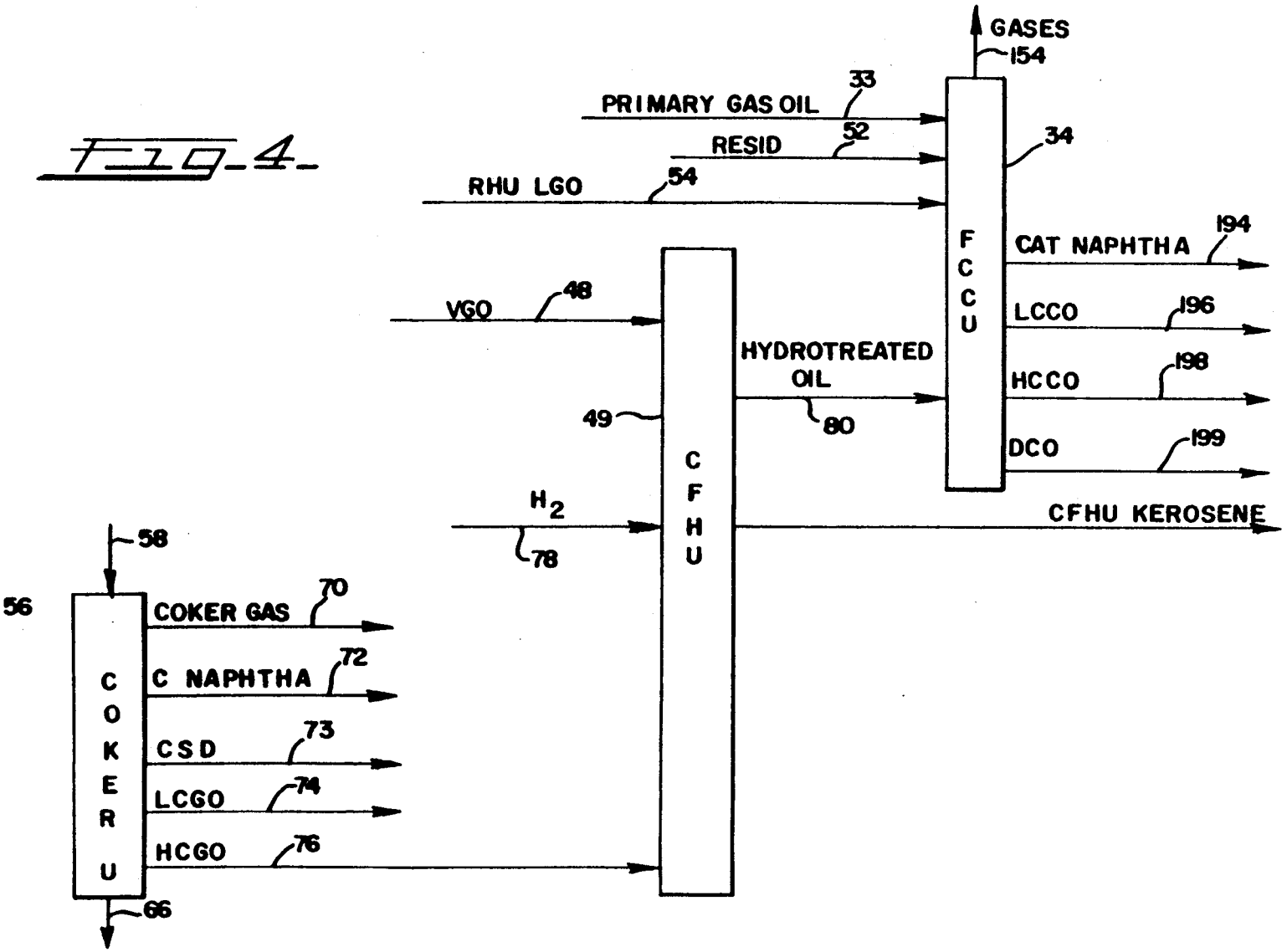
FIG. 4 is a schematic flow diagram of another part of the oil refinery.

Wet gas is withdrawn from the primary tower 26 through overhead wet gas line 28. Light naphtha is removed from the primary tower through light naphtha line 29. Intermediate naphtha is removed from the primary tower through intermediate naphtha line 30. Heavy naphtha is withdrawn from the primary tower 26 through heavy naphtha line 31. Kerosene and oil for producing jet fuel and furnace oil are removed from the primary tower through kerosene line 32. Part of the kerosene and/or heavy naphtha can be fed to the quench line 186 (FIG. 1) for use as part of the quench, if desired. Primary virgin, atmospheric gas oil is removed from the primary tower through primary gas oil line 33 and pumped to the fluid catalytic cracking unit (FCCU) 34 (FIG. 4), sometimes via a catalytic feed hydrotreating unit.

Primary reduced crude is discharged from the bottom of the primary tower 26 (FIG. 3) through the primary reduced crude line 35. The primary reduced crude in line 35 is pumped by pump 36 into a furnace 38 where it is heated, such as to a temperature from about 520° F. (271° C.) to about 750° F. (399° C.) The heated primary reduced crude is conveyed through a furnace discharge line 40 into the flash zone of a pipestill vacuum tower 42 or directly to the FCU reactor.

The pipestill vacuum tower 42 (FIG. 3) is preferably operated at a pressure ranging from 35 to 50 mm of mercury. Steam can be injected into the bottom portion of the vacuum tower through steam line 44. In the vacuum tower, wet gas or vacuum condensate is withdrawn from the top of the tower through overhead wet gas line 46. Heavy and/or light vacuum gas oil are removed from the middle portion of the vacuum tower through gas oil line 48 and can be fed to a catalytic feed hydrotreating unit (CFHU) 49 (FIG. 4) or to the riser reactor. Vacuum-reduced crude is removed from the bottom of the vacuum tower 42 (FIG. 3) through a vacuum-reduced crude line 50. The vacuum-reduced crude, also referred to as resid or resid oil, typically has an initial boiling point near about 1000° F. (538° C.).

Some of the resid can be pumped and fed to the FCCU 34 (FIG. 4) via FCCU resid line 52 or upgraded in a resid hydrotreating unit (RHU) comprising a series of ebullated, expanded bed reactors. Light gas oil (LGO) from the RHU can also be fed to the FCCU 34 via an RHU LGO line 54. Some of the resid can be pumped to a coker unit 56 via a coker resid line 58.

Figure 5:
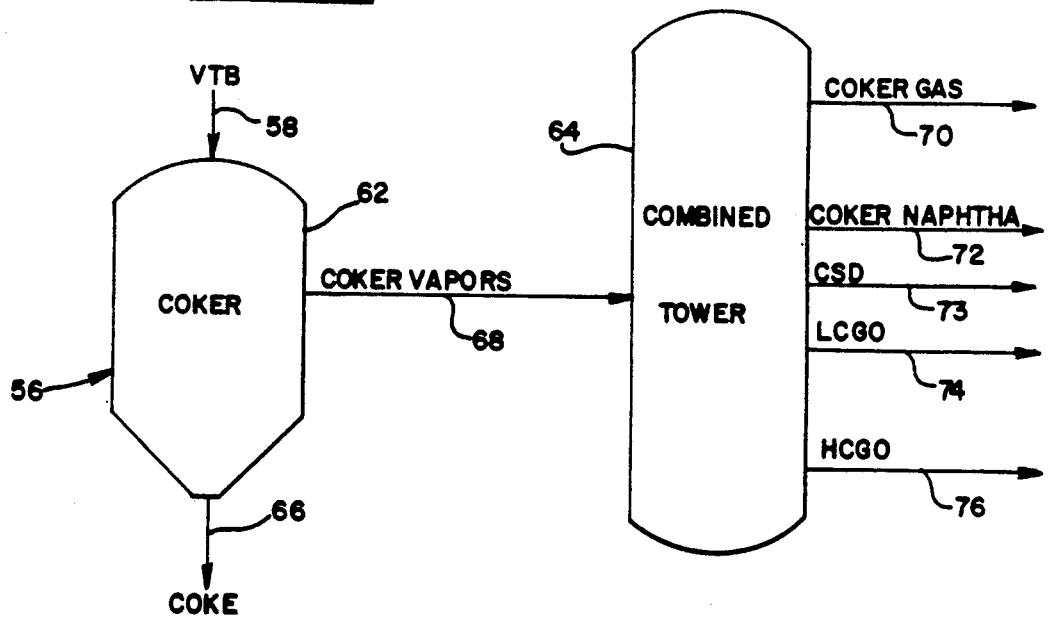
FIG. 5 is a schematic flow diagram of a coker unit.

The coker unit 56 (FIG. 5) comprises a coker or coke drum 62 and a combined tower 64. In the coker 62, the vacuum tower bottoms are coked at a coking temperature of about 895° F. (479° C.) to about 915° F. (491° C.) at a pressure of about 10 psig to about 50 psig. Coke is withdrawn from the coker 62 a through chute, conduit, or line 66 and transported to a coke storage area for use as solid fuel. Coker product vapors can be withdrawn from the coker 62 through coker vapor line 68 and passed (fed) to a combined coker tower 64. In the combined coker tower 64, the coker product vapor can be separated into fractions of coker gas, coker naphtha, light coker gas oil, coke still distillate (coker distillate) and heavy coker gas oil. Coker gas can be withdrawn from the combined tower 64 through coker gas line 70. Coker naphtha can be withdrawn from the combined tower 64 through coker naphtha line 72. Coke still distillate (coker distillate) can be withdrawn from the combined tower 64 through coke still distillate CSD line 73. Light coker gas oil can be withdrawn from the combined tower 64 through light coker gas line 74 and fed to the FCCU 34 (FIG. 4) or the catalytic feed hydrotreater (CFHU) 49. Part of the coke still distillate (coker distillate), light coker gas oil, and/or coker gas can be fed to the quench line 186 for use as part of the quench, if desired. Heavy coker gas oil can be withdrawn from the combined tower 64 (FIG. 5) through heavy coker gas oil line 76 and hydrotreated in the catalytic feed hydrotreater (CFHU) 49 (FIG. 4) before being catalytically cracked in the catalytic cracker 34 (FCCU).

Heavy coker gas oil from heavy coker gas oil line 76 (FIG. 5) and light vacuum gas oil and/or heavy vacuum gas oil from vacuum gas oil line 48 (FIG. 3) are conveyed to the riser reactor 100, or alternatively, to the catalytic feed hydrotreater or catalytic feed hydrotreatering unit (CFHU) 49 (FIG. 4) where they are hydrotreated with hydrogen from hydrogen feed line 78 at a pressure ranging from atmospheric pressure to 2000 psia, preferably from 1000 psia to 1800 psia at a temperature ranging from 650° F. (343° C.) to 750° F. (399° C.) in the presence of a hydrotreating catalyst. The hydrotreated gas oil is discharged through a catalytic feed hydrotreater discharge line 80 and fed to the catalytic cracker 34 (FCCU).

Figure 1:
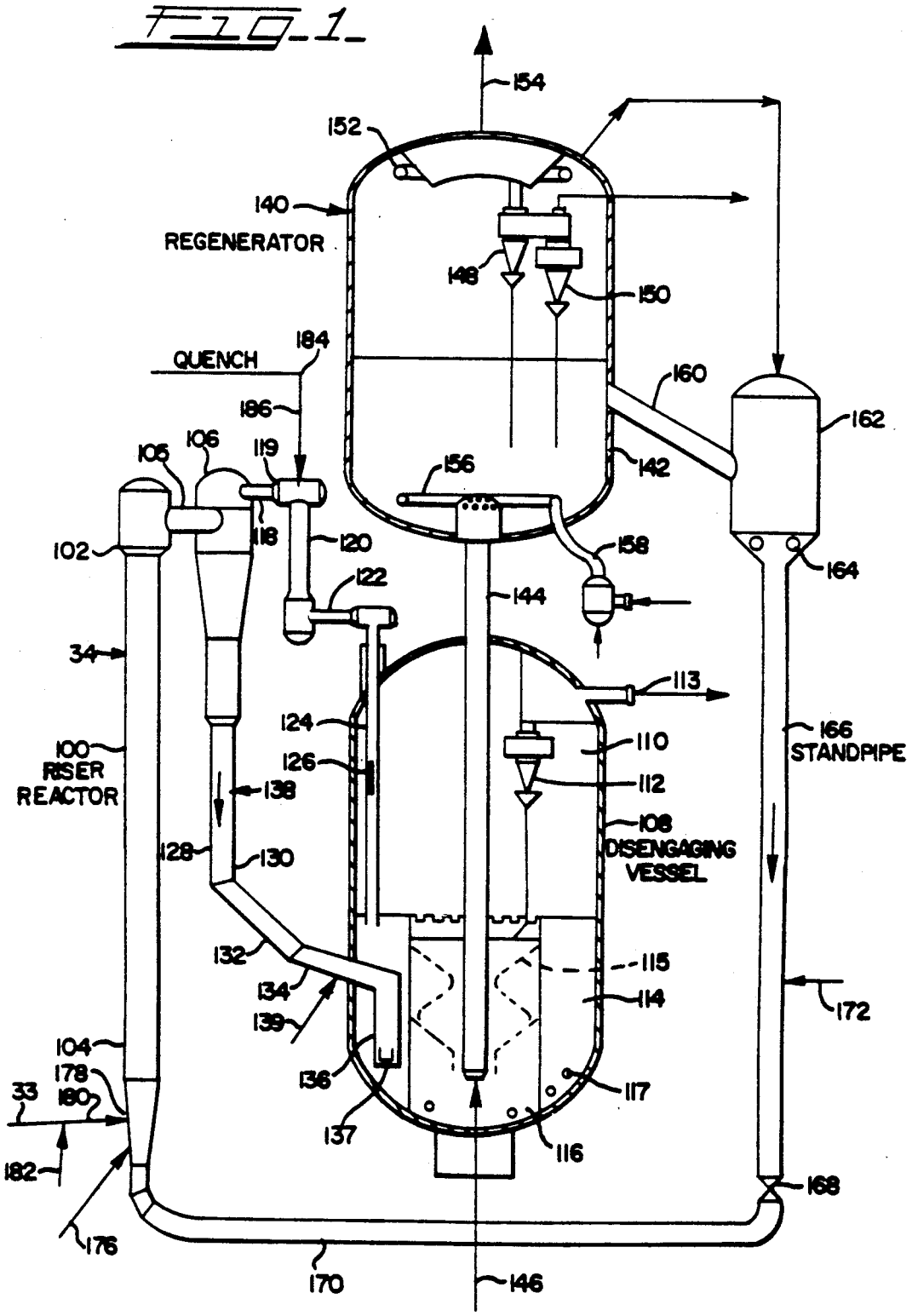
FIG. 1 is a schematic flow diagram of a catalytic cracking unit with an external cyclone.

The catalytic cracking reactor 34 of FIG. 1 has an upright elongated vertical riser reactor 100 with an upper portion 102 and a lower portion 104. Cracking catalyst and feed oil are mixed in the bottom of the riser reactor 100. The catalytic cracker (riser reactor) 100 catalytically cracks feed oil in the presence of a cracking catalyst under catalytic cracking conditions to produce an upgraded effluent product. Stream of catalytically cracked oil containing particulates of spent coked cracking catalyst.

A gross cut inertia separator comprising an external rough cut cyclone 106 (FIG. 1) is connected to and communicates with the upper portion of the riser reactor 100 via a cyclone inlet line 105. The external rough cut cycline 106 is positioned about and at a similar elevation as the upper portion 102 of the riser reactor 100. The rough cut cyclone makes a gross separation of the coked catalyst from the catalytically cracked oil. Preferably, at least 92% to 98% of the coked catalyst in the oil is removed by the rough cut cyclone 106. Positioned downstream of the external cyclone 106 is an upright disengaging vessel or disengager 108.

The disengaging vessel 108 (FIG. 1) disengages and separates a substantial amount of the remaining coked catalyst from the catalytically cracked oil. The disengaging vessel 108 operates at a temperature of 900° F. (482° C.) to 975° F. (524° C.). The disengaging vessel 108 has an upper dilute phase portion 110 with at least one internal cyclone 112, an effluent product outlet line 113, a lower dense phase portion 114, and a stripping section 116 providing a stripper in which volatile hydrocarbons are stripped from the coked catalyst. The stripping section can have baffles or internals 115. Stripping steam lines and injectors 117 can be connected to the stripper 116.

Extending from the upper portion of the external cyclone 106 (FIG. 1) is a cyclone outlet line 118 providing part of the product stream line 119. The product stream line 119 has an upper horizontal section 118, a vertical intermediate section 120, an intermediate horizontal section 122, and an elongated vertical section 124 providing a product stream dipleg which extends downwardlly through the upper dilute phase portion 110 of the disengaging vessel 108 to the upper section of the dense phase portion 114. The product stream dipleg 124 with an internal inertia separator providing an outlet 126 located in and communicating with the intermediate section of the upper dilute phase portion of the disengaging vessel 108. The product stream line 118 provides a disengaging vessel input line which extends between, connects and communicates with the external cyclone 106 and the upper dilute phase portion 110 of the disengaging vessel 108.

A cyclone outlet spent catalyst line, conduit, and chute provides a catalyst dipleg 128 which extends into the lower dense phase portion 114 adjacent the stripping section 116 of the disengaging vessel 108. The catalyst dipleg 128 has an upper vertical section 130, an intermediate angle section 132, a lower angle section 134, and a vertical dipleg end section 136 with an outlet opening 137. An aeration steam line 138 can be connected to the upper vertical section 130. A fluidizing steam line 139 can be connected to the lower angle section 134.

A regenerator 140 (FIG. 1) comprising a regenerator vessel 142 is positioned above the disengaging vessel 108. The regenerator 140 substantially combusts and regenerates the spent coke catalyst in the presence of a combustion sustaining oxygen-containing gas, such as air. An upright vertical elongated lift pipe 144 provides a spent catalyst riser and line, which extends downwardly from the lower portion of the regeneration vessel 142 through the middle section of the dense phase portion 114 of the disengaging vessel 108 for transporting coked catalyst from the disengaging vessel 108 to the overhead regenerator vessel 142.

A lift air injector 146 is positioned near the bottom of the lift pipe 144 for injecting air, lifting and transporting the spent catalyst to the regenerator vessel 142 and facilitating combustion of the coked catalyst. The regenerator vessel 142 can have internal cyclones 148 and 150, an upper dilute phase steam ring 152, an overhead flue gas line 154 and a lower dense phase fuel gas ring 156 and line 158.

Regenerated catalyst is discharged through a catalyst discharge line, conduit, and chute 160 (FIG. 1) to an overhead withdrawal well and vessel 162 with an optional air ring 164 in its lower portion to offset pressure buildup. A vertical regenerated catalyst standpipe 166 extends downwardly from the withdrawal well 162 to a slide valve 168. A horizontal regenerated catalyst line 170 is connected to the lower portion 104 of the riser reactor 100 to convey regenerated catalyst to the riser reactor. A fluidization steam line 171 can be connected to the regenerated catalyst line 170 below the slide valve 168. An aeration air line 172 can be connected to the middle portion of the regenerated catalyst standpipe 166.

An aeration steam line 176 (FIG. 1) can also be connected to the lower portion 104 of the riser reactor 100. Injector nozzles 178 (FIG. 1) can be positioned in the lower portion 104 of the riser reactor 100 to inject the feed oil into the riser reactor. In the illustrated embodiment, a combined feed oil line 180 is connected to the nozzles 178 and to a fresh feed oil line 33. A recycle oil line 182 can be connected to and communicate with the combined feed oil line 180 to feed heavy catalytic cycle oil (HCCO), decanted oil (DCO) and/or slurry oil to the riser reactor 100, of up to 40%, preferably at a rate of 5% to 10%, by volume of the fresh feed rate in fresh feed oil line 33. The temperature of the regenerator is decreased from about 1° F. to about 20° F., by cycle oil quenching.

A catalytic cycle oil quench injection line 184, comprising a LCCO injection line and/or an HCCO injection line, with a vertical catalytic cycle oil injector section 186 extends downwardly, connects and communicates with the vertical section 120 of the disengaging vessel input line 118 to inject a light cycle oil (LCCO) quench and/or a heavy catalytic oil (HCCO) quench into the hydrocarbon products after the products have exited the external cycline 106 downstream of the riser reactor 100 and before the products have entered the disengaging vessel 108. The quench minimizes and inhibits substantial thermal cracking of the product stream of catalytically cracked grossly separated oil to less valuable hydrocarbons, such as fuel gas. Cycle oil quenching stops about 75% to 90% of thermal cracking of the product oil and concurrently enhances the yield of naphtha to increase the production of gasoline. During quenching, the temperature of the product stream of oil being discharged from the rough cut cylone 106 is decreased from about 30° F. (17° C.) to about 200° F. (93° C.), preferably about 50° F. (28° C. )to about 80° F. (44° C.), such as to a range of 900° F. (482° C.) to about 930° F. (499° C.).

Cycle oil quenching enhances the conversion of feed oil to upgraded oil and increases gasoline octane. The injection rate of the quench by volume ranges from 2% to 20%, preferably from 5% to 15%, of the input rate of feed oil in the riser reactor 100. Advantageously, less coke is produced in the dilute phase portion 110 of the disengaging vessel 108. Less $C_2$-fuel gas is also produced during cycle oil quenching.

Mixing and vaporization of the quench can be advantageously increased to less than 5 seconds and preferably less than 3 seconds by spraying the quench with one or more atomized quench injectors to provide a quick contact quench and assure rapid mixing. The quench is injected at a downward velocity of 50 to 100 ft/sec (15 to 30 m/sec.) at a residence time of 0.1 to 5 seconds, preferably less than 0.2 seconds. Losses of quench should be avoided.

High boiling quench media improves energy recovery. The quench can be preheated, preferably above 212° F. (100° C.) to enhance heat recovery and minimize heat loss. Quench is sprayed into the external cyclone vapor exit line 118 to rapidly cool the products entering the reactor vessel dilute phase.

For best results, the quench is injected as soon as the reaction is completed and preferably immediately after the coked catalyst particulates have been grossly separated from the product stream of catalytically cracked oil. Laser amounts of quench are required after catalyst separation than before catalyst separation.

It was unexpectedly and surprisingly found that the use of cycle oil quench increase the yield of high value naphtha and can improve coke make and selectivity.

It appears that gas oil conversion beyond the riser reactor is substantially completed in the rough cut cyclone where catalyst is present. Excess fuel gas production has previously been associated with long residence time in the dilute phase portion of the disengaging vessel as a result of the thermal cracking before the addition of cycle oil quench.

Regenerated catalytic cracking catalyst can be fed to the riser reactor 100 (FIG. 1) through a regenerated catalyst line 170, respectively. Fresh makeup catalyst can be added to the regenerator 140. In the FCC riser reactor, the hydrocarbon feedstock is vaporized upon being mixed with the hot cracking catalyst and the feedstock is catalytically cracked to more valuable, lower molecular weight hydrocarbons. The temperatures in the riser reactor 100 can range from about 900° F. (482° C.) to about 1200° F. (649° C.), preferably from about 950° F. (510° C.) to about 1040° F. (560° C.), at a pressure from atmospheric pressure to about 50 psig. Weight hourly space velocity in the riser reactor can range from about 5 to about 200 WHSV. The velocity of the oil vapors in the riser reactor can range from about 5 ft/sec (1.5 m/sec) to about 100 ft/sec (30 m/sec).

Suitable cracking catalysts include, but are not limited to, those containing silica and/or alumina, including the acidic type. The cracking catalyst may contain other refractory metal oxides such as magnesia or zirconia. Preferred cracking catalysts are those containing crystalline aluminosilicates, zeolites, or molecular sieves in an amount sufficient to materially increase the cracking activity of the catalyst, e.g., between about 1 and about 50% by weight. The crystalline aluminosilicates can have silica-to-alumina mole ratios of at least about 2:1, such as from about 2 to 12:1, preferably about 4 to 6:1, for best results. The crystalline aluminosilicates are usually available or made is sodium form, and this component is preferably reduced, for instance, to less than about 4 or even less than about 1% by weight through exchange with hydrogen ions, hydrogen-precursors such as ammonium ions, or polyvalent metal ions. Suitable polyvalent metals include calcium, strontium, barium, and the rare earth metals such as cerium, lanthanum, neodymium, and/or naturally-occuring mixtures of the rare earth metals. Such crystalline materials are able to maintain their pore structure under the high-temperature conditions of catalyst manufacture, hydrocarbon processing, and catalyst regeneration. The crystalline aluminosilicates often have a uniform pore structure of exceedingly small size with the cross-sectional diameter of the pores being in a size range of about 6 to 20 angstroms, preferably about 10 to 15 angstroms. Silica-alumina based cracking catalysts having a major proportion of silica, e.g., about 60% to 90% by weight silica and about 10% to 40% by weight alumina, are suitable for admixture with the crystalline aluminosilicate or for use as the cracking catalyst. Other cracking catalysts and pore sizes can be used. The cracking catalyst can also contain or comprise a carbon monoxide (CO) burning promoter or catalyst, such as a platinum catalyst, to enhance the combustion of carbon monoxide in the dense phase in the regenerator 140.

Spent catalyst containing deactivating deposits of coke is discharged from the disengaging vessel 108 and lifted upward through the spent catalyst riser 144 and fed to the bottom portion of the overhead fluidized catalyst regenerator or combustion 140. The riser reactor and regenerator together provide the primary components of the catalytic cracking unit. Air is injected upwardly to the bottom portion of the regenerator via the air injector line 146 and spent catalyst riser 144. The air is injected at a pressure and flow rate to fluidize the spent catalyst particles generally upwardly within the regenerator. Residual carbon (coke) contained on the catalyst particles is substantially completely combusted in the regenerator 140 leaving regenerated catalyst for use in the reactor. The regenerated catalyst is discharged from the regenerator 140 through regenerated catalyst line 160 and fed to the riser reactor 100 via the regenerated catalyst line 170 and the regenerated catalyst standpipe 172. The combustion off-gases (flue gasese are withdrawn from the top of the combustor 140 through an overhead combustion off-gas line or flue gas line 154.

Figure 6:
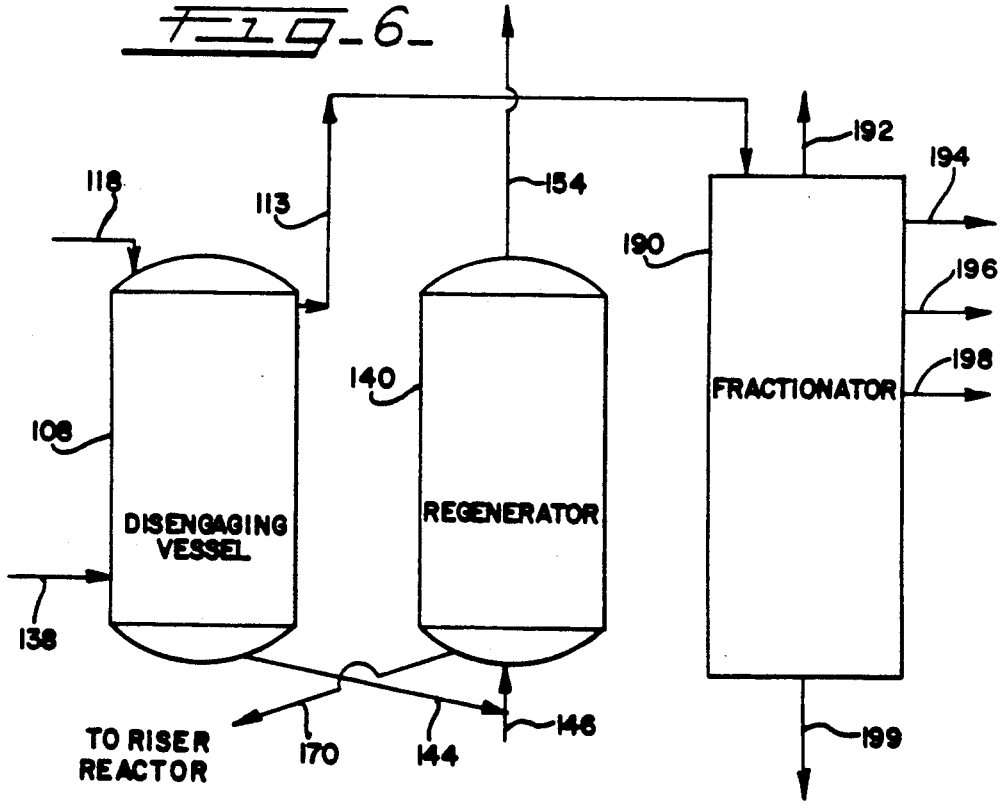
FIG. 6 is a schematic flow diagram of a catalytic cracking unit.

As shown in FIG. 6, the effluent product stream of catalytically cracked hydrocarbons (volatized oil) is withdrawn from the top of disengaging vessel 108 through an effluent product line 113 and conveyed to the FCC main fractionator 190. In the FCC fractionator 190, the catalytically cracked hydrocarbons comprising oil vapors and flashed vapors can be fractionated (separated) into light hydrocarbon gases, naphtha, light catalytic cycle oil (LCCO), heavy catalytic cycle oil (HCCO), and decanted oil (DCO). Light hydrocarbons gases are withdrawn from the FCC fractionator through a light gas line 192. Naphtha is withdrawn from the FCC fractionator through a naphtha line 194, LCCO is withdrawn from the FCC fractionator through a light catalytic cycle oil line 196. HCCO is withdrawn from the FCC fractionator through a heavy catalytic cycle oil line 198. Decanted oil is withdrawn from the bottom of the FCC fractionator through a decanted oil line 199. Part of the LCCO and/or HCCO can be recycled to the cycle oil quench line 184 (FIG. 1) for use as the quench.

Alternatively, in the main fractionator 402, the oil vapors and flashed vapors can be fractionated (separated) into: (a) light hydrocarbons having a boiling temperature less than about 430° F. (221° C.), (b) light catalytic cycle oil (LCCO), and (c) decanted oil (DCO). The light hydrocarbons can be withdrawn from the main fractionator through an overhead line and fed to a separator drum. In the separator drum, the light hydrocarbons can be separated into (1) wet gas and (2) $C_2$ to 430−° F. (221−° C.) light hydrocarbon material comprising propane, propylene, butane, butylene, and naphtha. The wet gas can be withdrawn from the separator drum through a wet gas line and further processed in a vapor recovery unit (VRU). The $C_3$ to 430−° F. (221−° C.) material can be withdrawn from the separator drum through a discharge line and passed to the vapor recovery unit (VRU) for further processing. LCCO can be withdrawn from the main fractionator through an LCCO line for use as part of the quench or further refining, processing, or marketing. Decanted oil (DCO) can be withdrawn from the main fractionator through one or more DCO lines for further use. Slurry recycle comprising decanted oil (DCO) can be pumped from the DCO line 199 (FIG. 6) at the bottom portion of the main fractionator 190 by a pump through a slurry line 182 (FIG. 1) for recycle to the riser reactor 100. The remainder of the DCO can be conveyed through for further use in the refinery.

Spent deactivated (used) coked catalyst discharged from the riser reactor 100 (FIG. 1) can be stripped of volatilizable hydrocarbons in the stripper section 116 with a stripping gas, such as with light hydrocarbon gases or steam. The stripped, coked catalyst is passed from the stripper 116 through spent catalyst line 144 into the regenerator 140. Air is injected through air injector line 146 to fluidize and carry the spent coked catalyst into the regenerator 140 via the spent catalyst riser 144 at a rate of about 0.2 ft/sec (0.06 m/sec) to about 4 ft/sec (1.22 m/sec). Preferably, excess air is injected in the regenerator 140 to completely convert the coke on the catalyst to carbon dioxide and steam. The excess air can be from about 2.5% to about 25% greater than the stoichiometric amount of air necessary for the complete conversion of coke to carbon dioxide and steam.

In the regenerator 140 (FIG. 1), the coke on the catalyst is combusted in the presence of air so that the catalyst contains less than about 0.1% coke by weight. The coked catalyst is contained in the lower dense phase section of the regenerator, below an upper dilute phase section of the regenerator. Carbon monoxide (CO) can be combusted in both the dense phase and the dilute phase, although combustion of carbon monoxide predominantly occurs in the dense phase with promoted burning, i.e., the use of a CO burning promoter. The temperature in the dense phase can range from about 1050° F. (566° C.) to about 1400° F. (760° C.). The temperature in dilute phase can range from about 1200° F. (649° C.) to about 1510° F. (821° C.). The stack gas (combustion gases) exiting the regenerator 140 through overhead flue line 154 preferably contains less than about 0.2% CO by volume (2000 ppm). The major portion of the heat of combustion of carbon monoxide is preferably absorbed by the catalyst and is transferred with the regenerated catalyst through the regenerated catalyst line 170 and standpipe 166 to riser reactor 100.

In a catalytic cracker (riser reactor) 100, some nonvolatile carbonaceous material, or coke, is deposited on the catalyst particles. Coke comprises highly condensed aromatic hydrocarbon which generally contain 4–10 wt. % hydrogen. As coke builds up on the catalyst, the activity of the catalyst for cracking and the selectivity of the catalyst for producing gasoline blending stock diminish. The catalyst particles can recover a major proportion of their original capabilities by removal of most of the coke from the catalyst by a suitable regeneration process.

Catalyst regeneration is accomplished by burning the coke deposits from the catalyst surface with an oxygen-containing gas such as air. The burning of coke deposits from the catalyst requires a large volume of oxygen or air. Oxidation of coke may be characterized in a simplified manner as the oxidation of carbon and may be represented by the following chemical equations:

$$C+O_2 \rightarrow CO_2 \quad \text{a.}$$

$$2C+O_2 \rightarrow 2CO \quad \text{b.}$$

$$2CO+O_2 \rightarrow 2CO_2 \quad \text{c.}$$

Reactions (a) and (b) both occur at typical catalyst regeneration conditions wherein the catalyst temperature may range from about 1050° F. (566° C.) to about 1300° F. (704° C.) and are exemplary of gas-solid chemical interactions when regenerating catalyst at temperatures within this range. The effect of any increase in temperature is reflected in an increased rate of combustion of carbon and a more complete removal of carbon, or coke, from the catalyst particles. As the increased rate of combustion is accompanied by an increased evolution of heat whenever sufficient oxygen is present, the gas phase reaction (c) may occur. This latter reaction is initiated and propagated by free radicals. Further combustion of CO to $CO_2$ is an attractive source of heat energy because reaction (c) is highly exothermic.

Figure 2:
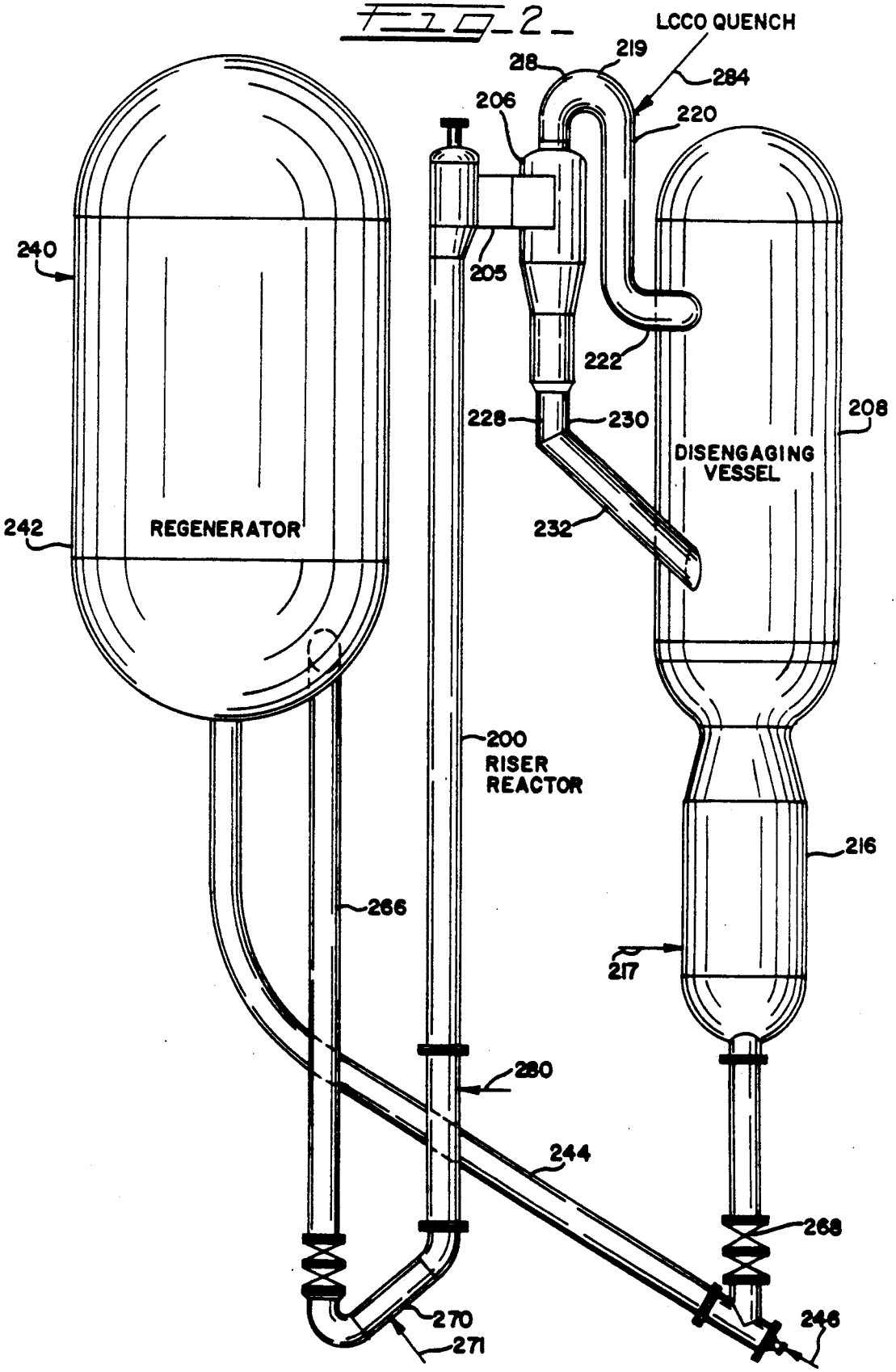
FIG. 2 is a schematic flow diagram of another catalytic cracking unit with an external cyclone.

The catalytic cracker (catalytic cracking unit) of FIG. 2 is generally structurally and functionally similar to the catalytic cracker of FIG. 1, except that the light catalytic cycle oil (LCCO) quench line 284 is at an angle of inclination ranging from about 15 degrees to about 45 degrees, preferably about 30 degrees, relative to the vertical to increase the trajectory of the quench and enhance more uniform blending. The regenerator vessel 242 is also positioned laterally away from the disengaging vessel 208. For ease of understanding, the parts, elements, and components of the catalytic cracker of FIG. 2 have been given part numbers similar to the corresponding parts, elements, and components of the catalytic cracker of FIG. 1, except increased by 100, i.e., in the 200 series, e.g., riser reactor 200, external cyclone 206, disengaging vessel 208, stripper 216, regenerator 240, etc. The catalytic cracking reactor preferably comprises a riser reactor. Some catalytic cracking units can have two riser reactors, two rough out cyclones, two slide valves, and two standpipes operatively connected to a single regenerator and to a single disengaging vessel.

In some circumstances, it may be desirable to use a fluid bed reactor or a fluidized catalytic cracking reactor instead of or with a riser reactor.

EXAMPLES

The following examples serve to give specific illustration of the practice of this invention but are not intended in any way to limit the scope of this invention.

EXAMPLES 1 AND 2

Experimental tests were conducted in a catalytic cracking unit (Unit Y) similar to that shown in FIG. 1. The test of Example 1 provided the base case. Catalytic cracking in Example 1 proceeded without a LCCO quench. Catalytic cracking in the test of Example 2 was conducted with an LCCO quench with a temporary gerry-rig quench line. The operating conditions and test results are shown below. The LCCO quenching test produced unexpected, surprisingly good results since naphtha octanes increased by 0.2 RM/2, conversion increased by 0.64 volume %, naphtha yield increased by 0.5 volume %, heavy catalytic naphtha stability improved, $C_2$-gas yield decreased by 23% by weight, and coke selectivity (e.g. coke yield/conversion) improved. The extent, amount, and quality of the products produced during catalytic cracking with LCCO quench were unexpected. Such increase due to LCCO quenching has produced a substantial increase in product value.

| | Example 1 | Example 2 | Difference Delta |
|---|---|---|---|
| LCCO Quench, MB/D | 0.0 | 1.5 | +1.5 |
| Fresh Feed, MB/D | 24.6 | 24.7 | +0.1 |
| Riser, °F. | 955. | 956. | +1. |
| Rough-Cut Cyclone Overhead Line, °F. | 951. | 903. | −48. |
| Vapor Line from Disengaging Vessel to Main Fractionator, °F. | 940. | 903. | −34. |
| Temperature Difference Between Riser Reactor and & Disengaging Vessel, °F. | 15. | 53. | +38. |
| Preheater Temperature, °F. | 437. | 435. | −2. |
| HCCO Recycle, B/D | 710. | 790. | +80. |
| Slurry Recycle, B/D | 700. | 700. | 0. |
| Regen. Bed. Temp., F. | 1312. | 1305. | −7. |
| Conversion, Vol % | 69.15 | 69.79 | +0.64 |
| Fresh Feed Properties | | | |
| API Gravity | 23.9 | 24.0 | +0.1 |
| Nitrogen, Wt % | 0.112 | 0.111 | −0.001 |
| Sulfur, Wt % | 1.23 | 1.22 | −0.01 |
| Gas Oil, Vol % | 97.8 | 97.6 | +0.2 |
| Conversion, Vol % | 69.15 | 69.79 | +0.64 |
| TC2−, Wt % | 3.34 | 3.11 | −0.23 |
| TC3, Vol % | 10.80 | 10.90 | +0.10 |
| C3=/TC3 | 0.689 | 0.693 | +0.004 |
| TC4, Vol % | 13.19 | 13.52 | +0.33 |
| C4=/TC4 | 0.524 | 0.513 | −0.009 |
| iC4/C4 saturates | 0.789 | 0.785 | −0.004 |
| C5/430, Vol % gasoline blending material, e.g. pentane, pentene | 51.83 | 52.33 | +0.50 |
| LCCO, Vol % | 25.54 | 24.91 | −0.63 |

-continued

| | Example 1 | Example 2 | Difference Delta |
|---|---|---|---|
| DCO, Vol % | 4.62 | 4.57 | −0.05 |
| Coke, Wt % | 5.90 | 6.16 | +0.26 |
| Volume Recovery, Vol % | 105.99 | 106.24 | +0.24 |
| C5/430 | | | |
| RCL Octane | 93.7 | 93.9 | +0.2 |
| MCL Octane | 81.4 | 81.6 | +0.2 |
| LCN | | | |
| induction period, min | 25 | 25 | 0 |
| RON | 94.5 | 94.5 | 0 |
| MON | 80.2 | 80.2 | 0 |
| HCN | | | |
| induction period | 395 | 615 | +220 |
| RON | 92.9 | 93.4 | +1.6 |
| MON | 80.9 | 81.4 | +0.5 |

EXAMPLES 3 AND 4

Bench study tests were performed on kerosene to simulate catalytically cracked oil after the coke catalyst particles have been removed. In the tests of Examples 3 and 4, the quench rate was 60 grams/hr and the oil product rate was 125 grams/hour. The quench of Example 3 was HCCO. The quench of Example 4 was LCCO. Quench results of HCCO and LCCO were very similar and are reported below

| | Example 3 | Example 4 |
|---|---|---|
| Reactor, °F. | 1095 | 1100 |
| C2− fuel gas (wt %) | | |
| Isothermal at quenching | 14 | 16+ |
| 20 minutes of cooling | 10 | 9 |
| 60 minutes of cooling | 8 | 6 |

EXAMPLES 5 AND 6

Experimental tests were conducted in another catalytic cracking unit (FCCU 500) similar to that shown in FIG. 2. The test of Example 3 provided a base case without the use of a LCCO. Catalytic cracking in the test of Example 6 was performed with a LCCO quench. The oil feed rate was 79 MBD. Riser reactor temperature was 1020° F. (549° C.). Without LCCO quench, the reactor temperature at the top of the disengaging vessel was 12° F. below the riser reactor. At 5.6 MBD of LCCO quench, the riser reactor temperature decreased 53° F. (30° C.). LCCO quench yielded a desirable decrease in drying gas production by about 16.7% from 1140 MSCFH to 980 MSCFH, significantly increased gasoline production 4.4% from 39.5 MBD to 41.2 MBD, and increased volume recovery by about 1%. LCCO quenching also decreased the production of propane, propylene, and isobutane. The operating conditions and test results are:

| | Example 5 No quench | Example 6 with LCCO quench |
|---|---|---|
| LCCO quench rate | 0 MBD | 5.6 MBD |
| Riser temperature | 1020° F. (549° C.) | 1020° F. (549° C.) |
| Disengaging Vessel top temp. | 1008° F. (542° C.) | 967° F. (519° C.) |
| Temperature diff. between riser and disengager | +12° F. (7° C.) | +53° F. (30° C.) |
| $C_2$− dry gas | 1140 MSCFH | 980 MSCFH |
| $C_5$+ gasoline | 39.5 MBD | 41.2 MBD |
| Volume % recovery | 108.9% | 109.8% |

-continued

| | Example 5 No quench (wt. %) | Example 6 With quench (wt. %) | Difference Delta (wt. %) |
|---|---|---|---|
| $C_2$− dry gas | 4.8 | 4.0 | −.8 |
| Propane | 2.1 | 1.8 | −.3 |
| Propylene | 5.7 | 5.3 | −.4 |
| Isobutane | 3.7 | 3.5 | −.2 |
| N-butane | 1.2 | 1.2 | — |
| Butenes | 6.8 | 6.7 | — |
| $C_5$ gasoline | 41.2 | 43.0 | +1.8 |
| LCO/DCO | 29.4 | 29.3 | — |
| Coke | 5.1 | 5.2 | — |

EXAMPLES 7–9

Figure 10:
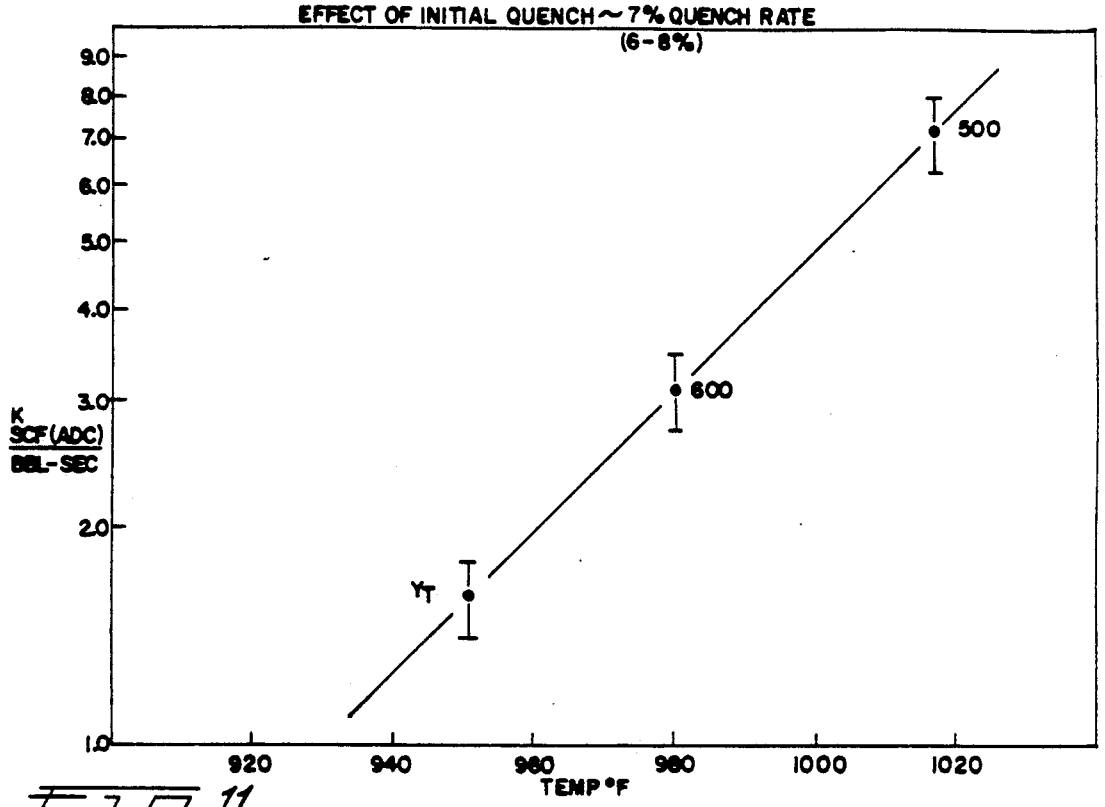
FIGS. 10 and 11 are charts of the effects of initial quench at different catalytic cracking units.
Figure 11:
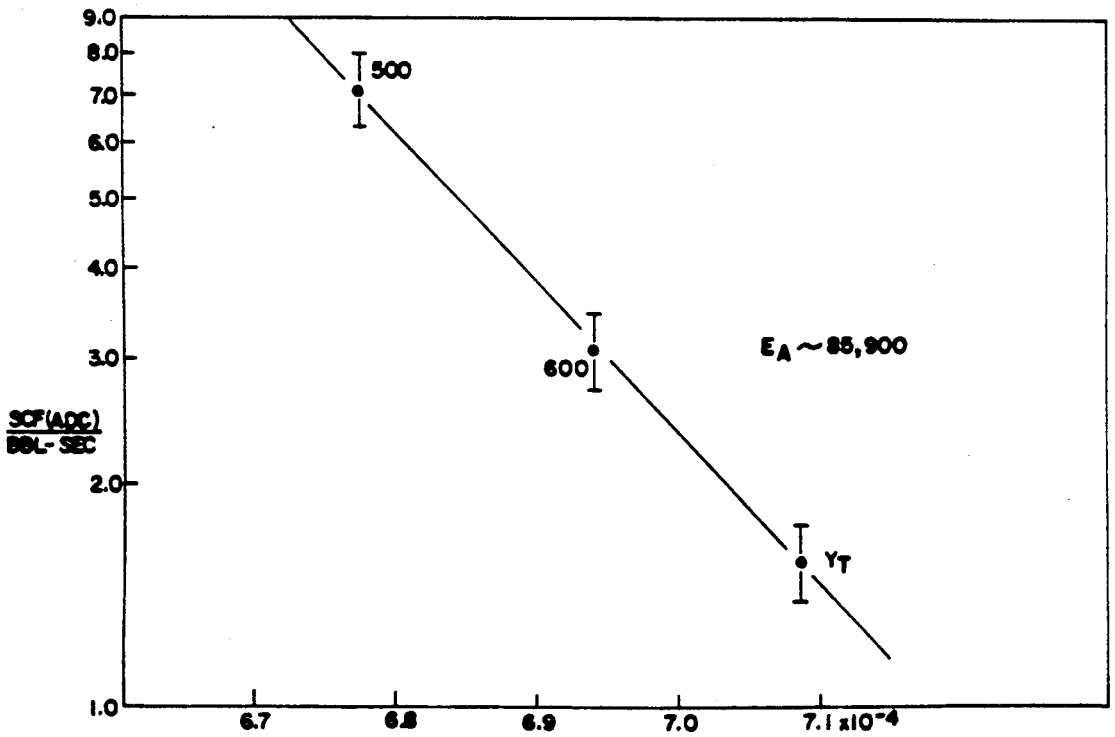

Further experimental tests were conducted at catalytic cracking units with cycle oil quenches. In Example 7, LCCO quench was injected immediately after the product exit of the external rough cut cyclone in a catalytic cracking unit (Unit Y) similar to that shown in FIG. 1 with a temporary gerry-rig quench line. Example 8, LCCO quench was injected immediately after the product exit of two external rough cut cyclones in another catalytic cracking unit (FCCU 500) similar to that shown in FIG. 2. In Example 9, HCCO quench was injected immediately after the product exited four internal rough cut cyclones in a disengager in a catalytic cracking unit (FCCU 600). Experimental test conditions and results are shown below and in the charts of FIGS. 10 and 11.

EXAMPLE 7

| | |
|---|---|
| Feed Rate | 24,700 B/D |
| Riser Outlet Temp. | 951 F. |
| Quench Media | LCCO |
| Quench Rate | 1500 B/D (6.1%) |
| Vapor Res Time in Disengager | 16 sec |
| Fuel Gas Reduction | 635 M SCFD |

$$K = \frac{635 \text{ M SCFD}}{24.7 \text{ M B/D (16 sec)}} = 1.61 \text{ SCF/BBL-Sec}$$

EXAMPLE 8

| | |
|---|---|
| Feed Rate | 77,000 B/D |
| Riser Outlet Temp. | 1017 F. |
| Quench Media | LCCO |
| Quench Rate | 5500 B/D (7.1%) |
| Vapor Res Time in Disengager | 9 sec |
| Fuel Gas Reduction | 5 MM SCFD |

$$K = \frac{5{,}000 \text{ M SCFD}}{77 \text{ M B/D (9 seconds)}} = 7.21 \text{ SCF/BBL-Sec}$$

EXAMPLE 9

| | |
|---|---|
| Feed Rate | 37,000 B/D |
| Riser Outlet Temp. | 980° F. |
| Quench Media | HCO |
| Quench Rate | ~3000 B/D (8.1%) |
| Vapor Res Time in Disengager | 13 sec |
| Fuel Gas Reduction | 1.5 MM SCFD |

$$K = \frac{1{,}500 \text{ M SCFD}}{37 \text{ M B/D (13 sec)}} = 3.12 \text{ SCF/BBL-Sec}$$

EXAMPLES 10–18

Increased reactor temperature at or above 940° F. (504° C.), but especially above 1000° F. (538° C.) diminishes the oxidation stability of the naphtha product and gasoline. Also, active matrix octane catalysts (cracking catalysts containing ultrastable-Y zeolite with or without rare earth exchanged into the zeolite, supported on a carrier matrix which exhibits cracking activity independent of the zeolite) will produce a less stable naphtha product and gasoline than will rare earth exchanged Y catalysts, which produce larger volumes of lower octane naphtha. Furthermore, inclusion of residual oil in the FCU feedstock mixture will diminish the stability of the naphtha product and gasoline.

Quenching in accordance with this invention can substantially increase the oxidation and storage stability of the naphtha product and gasoline by reducing the temperature in the dilute phase of the disengaging vessel as quickly as possible following the initial gross cut separation of the mixture of oil vapor product and catalyst.

Oxidation stability tests were conducted at catalytic cracking units with and without cycle oil quenches. In Examples 10–13, gas oil feed was catalytically cracked in a catalytic cracking unit (Unit Y) similar to that shown in FIG. 1 with a temporary gerry-rig quench line, and LCCO quench, if indicated, was injected immediately after the product exit of the external rough cut cyclone. In Examples 14–16, gas oil feed was catalytically cracked in a catalytic cracking unit (FCCU 500) similar to that shown in FIG. 2, and LCCO quench, if indicated, was injected immediately after the product exit of two rough cut cyclones. In Examples 17 and 18, gas oil feed was catalytically cracked in a catalytic cracking unit (FCCU 600) and HCCO quench, if indicated, was injected immediately after the product exited two internal rough cut cyclones in the disengager (disengaging vessel). Experimental test conditions and results are shown below:

EFFECT OF DILUTE PHASE FCU QUENCH ON FCCU NAPHTHA OXIDATION STABILITY

| Ex. | Unit | Product Stream | Riser Outlet Temperature, °F. | Dilute Phase Temperature, °F. |
|---|---|---|---|---|
| 10 | Y | Heavy Catalytic Naphtha | 940 | 940 |
| 11 | Y | Heavy Catalytic Naphtha | 941 | 903 |
| 12 | Y | Light Catalytic Naphtha | 940 | 940 |
| 13 | Y | Light Catalytic Naphtha | 941 | 903 |
| 14 | FCCU-500 | C5–430 Total Catalytic Naphtha | 1019 | 999 |
| 15 | FCCU-500. | C5–430 Total Catalytic Naphtha | 1020 | 940 |
| 16 | FCCU-500 | C5–430 Total Catalytic Naphtha | 1019 | 939 |
| 17 | FCCU-600 | FCU Wild Gasoline –2045 hrs | 1020 | 990 |
| 18 | FCCU-600 | FCU Wild Gasoline –2000 hrs | 1020 | 910 |

| Ex. | Quench Fluid | Feedstock Composition % HVGO | % Hydrotreated Gas Oil | % Resid | ASTM D-525 Stability, Minutes |
|---|---|---|---|---|---|
| 10 | None | 100 | 0 | 0 | 395 |
| 11 | LCCO | 100 | 0 | 0 | 615 |
| 12 | None | 100 | 0 | 0 | 25 |
| 13 | LCCO | 100 | 0 | 0 | 25 |
| 14 | None | 72 | 28 | 0 | 200 |
| 15 | LCCO | 78 | 22 | 0 | 225 |
| 16 | LCCO | 72 | 28 | 0 | 250 |
| 17 | None | 52 | 32 | 16 | 75 |
| 18 | HCCO | 52 | 32 | 16 | 125 |

The preceding Examples 10–18 show the beneficial effects on quench of product stability.

EXAMPLES 19–48

Further oxidation stability tests were conducted with cycle oil quenches. LCCO quench was injected immediately after the product exit of two rough cut cyclones in a catalytic cracking unit (FCCU 500) similar to FIG. 2. HCCO quench was injected immediately after the product exited two internal rough cut cyclones in the disengager (disengaging vessel) in a catalytic cracking unit (FCCU 600). The Catalyst Complex was comprised of FCCU 500 and FCCU 600. Weighted average riser outlet temperature reflects the relative flow rates of feed to each unit (FCCU 500 and FCCU 600) and the cracking temperature of each unit (FCCU 500 and FCCU 600). Stabilities of LCN and HCN were measured as received from a sample point in the rundown line. ULR is blended from LCN and HCN which have been treated with an antioxidant additive. Test conditions and results are shown below.

EFFECT OF QUENCHING ON THE OXIDATION STABILITY OF UNLEADED REGULAR (ULR) GASOLINES OF CONTAINING FCCU PRODUCT NAPHTHA

| Ex. | Riser Outlet Temperatures FCCU 500 | FCCU 600 | Weighted Average | Percent Resid in Feed to Catalytic Complex | % HCN in ULR | % LCN in ULR | % Total Catalytic Naphtha in ULR | ASTM D-525 Oxidation Stability ULR | LCN | HCN | LCCO Quench at FCCU 500 | HCCO Quench at FCCU 600 |
|---|---|---|---|---|---|---|---|---|---|---|---|---|
| 19 | 970 | 980 | 974 | 4.4 | 50.3 | 14.5 | 64.8 | 530 | 120 | 225 | yes | no |

-continued

EFFECT OF QUENCHING ON THE OXIDATION STABILITY OF UNLEADED REGULAR (ULR) GASOLINES OF CONTAINING FCCU PRODUCT NAPHTHA

| | | | | | | | | | | | | |
|---|---|---|---|---|---|---|---|---|---|---|---|---|
| 20 | 973 | 980 | 976 | 4.0 | 49.8 | 19.2 | 69.0 | 535 | 120 | 195 | yes | no |
| 21 | 980 | 980 | 980 | 4.2 | 56.5 | 14.0 | 70.5 | 465 | 90 | 200 | yes | no |
| 22 | 980 | 980 | 980 | 4.3 | 58.0 | 14.7 | 72.7 | 415 | — | — | yes | no |
| 23 | 980 | 980 | 980 | 4.7 | 56.0 | 9.2 | 65.2 | 400 | — | — | yes | no |
| Average | 977 | 980 | 978 | 4.3 | 54.1 | 14.3 | 68.4 | 469 | 110 | 207 | yes | no |
| Std. Deviation | 5 | — | 3 | 0.2 | 3.8 | 3.5 | 3.4 | 63 | 17 | 16 | — | — |
| 24 | 980 | 981 | 980 | 4.3 | 55.3 | 13.6 | 68.9 | 710 | 110 | >240 | yes | yes |
| 25 | 983 | 983 | 983 | 4.4 | 55.6 | 11.3 | 66.9 | 740 | 135 | 105 | yes | yes |
| 26 | 975 | 985 | 979 | 4.4 | 54.4 | 9.5 | 63.9 | 730 | 135 | >240 | yes | yes |
| 27 | 985 | 985 | 985 | 4.4 | 59.3 | 14.4 | 73.7 | 770 | 105 | >300 | yes | yes |
| 28 | 985 | 985 | 985 | 4.4 | 54.3 | 14.7 | 69.0 | 710 | 105 | — | yes | yes |
| 29 | 985 | 985 | 985 | 4.3 | 48.5 | 17.8 | 66.3 | 825 | 120 | >300 | yes | yes |
| 30 | 985 | 985 | 985 | 4.5 | 59.0 | 11.7 | 70.7 | 725 | — | — | yes | yes |
| Average | 983 | 984 | 983 | 4.4 | 55.2 | 13.3 | 68.5 | 744 | 118 | — | yes | yes |
| Std. Deviation | 4 | 2 | 3 | 0.1 | 3.6 | 2.7 | 3.2 | 41 | 14 | — | — | — |

| | Riser Outlet Temperatures | | | Percent Resid in Feed to | | | % Total Catalytic | ASTM D-525 Oxidation Stability | | | LCCO Quench | HCCO Quench |
|---|---|---|---|---|---|---|---|---|---|---|---|---|
| Ex. | FCCU 500 | FCCU 600 | Weighted Average | Catalytic Complex | % HCN in ULR | % LCN in ULR | Naphtha in ULR | ULR | LCN | HCN | at FCCU 500 | at FCCU 600 |
| 31 | 1010 | 1015 | 1012 | 6.4 | 56.0 | 12.3 | 68.3 | 415 | — | — | yes | no |
| 32 | 1010 | 1015 | 1012 | 6.5 | 56.0 | 12.6 | 68.6 | 420 | >240 | >240 | yes | no |
| 33 | 1010 | 1015 | 1012 | 6.4 | 50.0 | 15.2 | 65.2 | 395 | — | — | yes | no |
| 34 | 1010 | 1015 | 1012 | 6.4 | 52.0 | 15.7 | 67.7 | 330 | — | — | yes | no |
| 35 | 1010 | 1015 | 1012 | 5.8 | 49.0 | 14.8 | 63.8 | 340 | — | — | yes | no |
| 36 | 1010 | 1015 | 1012 | 5.5 | 56.0 | 9.0 | 65.0 | 355 | — | — | yes | no |
| 37 | 1010 | 1015 | 1012 | 5.4 | 55.1 | 12.5 | 67.6 | 335 | — | — | yes | no |
| 38 | 1010 | 1015 | 1012 | 5.4 | 55.1 | 12.5 | 67.6 | 320 | — | — | yes | no |
| 39 | 1012 | 1015 | 1013 | 5.5 | 54.7 | 12.7 | 67.4 | 340 | 90 | — | yes | no |
| 40 | 1012 | 1015 | 1013 | 5.7 | 56.5 | 10.5 | 67.0 | 330 | 105 | 75 | yes | no |
| 41 | 1013 | 1016 | 1014 | 5.4 | 59.3 | 13.6 | 72.9 | 335 | 90 | 135 | yes | no |
| Average | 1011 | 1015 | 1012 | 5.8 | 54.5 | 12.9 | 67.3 | 355 | — | — | yes | no |
| Std. Deviation | 1 | 0.2 | 1 | 0.5 | 3.0 | 2.0 | 2.4 | 36 | — | — | — | — |
| 42 | 1010 | 1020 | 1014 | 5.3 | 52.8 | 12.3 | 65.1 | 720 | 120 | — | yes | yes |
| 43 | 1010 | 1020 | 1014 | 5.3 | 52.8 | 12.3 | 65.1 | 720 | 105 | >300 | yes | yes |
| 44 | 1010 | 1020 | 1014 | 5.8 | 55.8 | 8.3 | 64.1 | 825 | 105 | >240 | yes | yes |
| 45 | 1010 | 1020 | 1014 | 6.0 | 50.0 | 10.3 | 60.3 | 710 | 105 | >240 | yes | yes |
| 46 | 1010 | 1020 | 1014 | 6.0 | 50.0 | 10.3 | 60.3 | 710 | 105 | >240 | yes | yes |

EXAMPLES 49-54

Quenching downstream of the rough cut cyclone also reduces the yield of diolefins. Diolefins (molecules containing two unsaturated carbon-carbon bonds) are believed to be the product of thermal rather than catalytic cracking reactions, and are formed in regions of the FCCU where the temperature is high, or where the residence time is long. By reducing the temperature in the disengaging zone, the application of quench will reduce the yield of diolefinic molecules.

C4 diolefins (butadienes, and in particular 1,3,butadiene) are considered detrimental in subsequent processing of FCCU butylenes in an isobutane alkylation unit; they cause a higher than desired dilution of the acid alkylation catalyst.

C5 diolefins, including, but not limited to isoprene, 1,3-pentadiene, and cyclopentadiene are considered similarly undesirable in an FCCU product stream. If the C5 FCCU product is charged to an isobutane alkylation unit, the C5 diolefins contained in this C5 hydrocarbon stream can cause a high dilution of the acid alkylation catalyst.

Alternatively, FCCU product streams containing C5 and high molecular weight diolefins may be blended into product gasolines. In gasoline, diolefins are suspected to contribute to product instability. The high reactivity of chemical compounds containing two unsaturated bonds will cause the diolefins to rapidly react with oxygen or other substances, forming undesired gums.

Accordingly, a process which produces a lower diolefin yield is to be desired. Quenching of the reactor dilute phase will lower the diolefin yield. The chemical reactions which contribute to instability in gasoline are complex. Diolefins are believed to participate in these reactions, but it is possible that the stability improvements with quenching in Examples 19-48 involve additional molecular compounds other than diolefins as well.

An example of the beneficial effect of quenching in reducing diolefin yields is given below. C5 diolefin yields from the tests are presented. Quenching is expected to change the yield of other diolefins in a similar fashion.

Yield tests were performed in a catalytic cracking unit (FCCU 500) similar to FIG. 2. Samples of the total overhead C5-430 naphtha product were obtained from the vapor product line leaving the disengaging vessel.

The samples in Examples 50 and 51 were taken with one riser reactor out of service. Only one riser reactor, discharging through a single external rough cut cyclone into the common disengaging vessel, was operating.

The samples taken in Examples 49 and 52-54 were taken with both riser reactors operating. Gas products from both external rough cut cyclones were quenched immediately downstream of the external rough cut cyclones with LCCO, then both quenched streams entered the common disengaging vessel.

The rates to each riser reactor in in Examples 49, 52, and 54 were identical but were reasonably split, roughly 50/50. For Example 53, the flow rate of quench was 2500 b/d to the A outlet, 4100 b/d to the B outlet, giving a total of 6600 b/d.

The following results were obtained:

| Tests Performed Without Quench | | | | |
|---|---|---|---|---|
| Ex. | Cracking Temp | Fresh Feed B/D | LCCO Quench B/D | C5 Diolefin Volume of Fresh Feed |
| 49 | 1016° F. (547° C.) | 73,500 | 0 | 0.21 |
| 50 | 1027° F. (553° C.) | 48,900 | 0 | 0.22 |
| 51 | 1027° F. (553° C.) | 48,900 | 0 | 0.17 |
| **Tests Performed With LCCO Quench** | | | | |
| Ex. | Cracking Temp | Fresh B/D | LCCO Quench B/D | C5 Diolefin Volume of Fresh Feed |
| 52 | 1009° F. (543° C.) | 80,600 | 7,000 | 0.08 |
| 53 | 1019° F. (548° C.) | 76,500 | 6,600 | 0.11 |
| 54 | 1020° F. (549° C.) | 74,600 | 6,300 | 0.11 |

At substantially the same cracking temperature, C5 diolefin yields were reduced approximately 35-50% by the application of LCCO quenching.

QUENCH SELECTION

In general, the quench should have a boiling point of 125° F. (52° C.), preferably at least 430° F. (221° C.) in order to have a sufficient heat capacity to effectively cool the catalytically cracked oil product to minimize thermal cracking of the oil product as well as to allow heat recovery at the bottom rather than the top of the fractionator. Desirably, the quench should have a molecular weight over 90 to limit the total volumetric expansion of the quench and oil product upon vaporization to 100% to 120%, preferably 103% to 105% or less, of the volume of the oil products without the quench, i.e., the volumetric expansion of the quench should be from 0 to 20%, preferably 3% to 5% or less of the volume of the catalytically cracked oil. Furthermore, the quench should be inactive and inert to thermal cracking at 900° F. (482° C.) to 1100° F. (593° C.) for a residence time of 1-30 seconds in the dilute phase zone of the disengaging vessel. Previously cracked hydrocarbons, such as LCCO, HCCO, HCN, coker gas oil and coker distillates, are very desirable as quenches since they are less reactive to thermal cracking than fresh unprocessed virgin stocks, such as virgin gas oil and virgin naphtha, and hydrotreated stocks, such as hydrotreated gas oil and hydrotreated distillates. Moreover, the quench preferably has a boiling point under 900° F. (482° C.) to completely vaporize in the dilute phase of the disengager in order provide effective cooling of the catalytically cracked oil product and avoid coking of the walls and lines of the refinery equipment.

It is also desirable that the quench decrease $C_2$ fuel gas production in order to allow higher operating temperatures at the catalytic cracking unit.

The properties of various quenches are shown in Table A. LCCO in this patent application also includes intermediate reflux on tower pump arounds with a boiling range, API gravity, and molecular weight similar to that shown for LCCO in Table A.

TABLE A

| Properties of Quenches | | | |
|---|---|---|---|
| | Nominal Boiling Point | Nominal API Gravity | Average Molecular Wt. |
| Light Catalytic Cycle Oil (LCCO) | 430-650° F. (221-343° C.) | 11-30 20 avg | 200-300 215 avg |
| Heavy Catalytic Cycle Oil (HCCO) | 650-850° F. (343-454° C.) | 2-25 10 avg | 250-350 |
| Heavy Catalytic Naphtha (HCN) | 300-430° F. (149-221° C.) | 20-50 35-40 avg | 100-250 |
| Light Coker Gas Oil (LCGO) | 650-1000° F. 720° F. avg (343-538° C. 382° C. avg) | 10-25 21 avg | 240-350 |
| Coker Still Distillates | 430-650° F. 504° F. avg (221-343° C. 262° C. avg) | 30-40 35 | 200-250 215 avg |
| Kerosene | 320-530° F. 400-450° F. avg (160-277° C. 204-232° C. avg) | 35-45 41 avg | 150-200 175 |
| Hydrotreated Distillate | 430-650° F. 560° F. avg (221-343° C. 293° C. avg) | 35-45 39.5 avg | 225-265 230 |
| Virgin Gas Oil (VGO) | 650-1000° F. (343-538)° C. | 21-32 25 avg | 300-400 350 avg |
| Heavy Virgin Naphtha (HVN) | 300-350° F. 325° F. avg (149-177° C. 163° C. avg) | 40-60 50 | 100-250 150 |
| Light Virgin Naphtha (LVN) | 125-175° F. 150° F. avg (52-79° C. 66° C. avg) | 60-80 70 | 70-150 125 |
| Hydrotreated Gas Oil (HGO) | 650-1000° F. (343-538° C.) | 24-35 29 avg | 300-400 350 avg |
| Decanted Oil (DCO) | 700-1200° F. 900° F. avg (371-649° C. 482° C. avg) | −4 to +10 +2 avg | 400-600 500 avg |
| Resid | 1000-1600° F. (538-871° C.) | 0-20 12 avg | 300-1000 700 avg |
| Water ($H_2O$) | 212° F. (100° C.) | 10 avg | 18 |

Quenching involves injecting a fluid, preferably a liquid, into the catalytic cracking unit, preferably immediate downstream of the gross cut separator (cyclone), to stop the reactions. Generally, a superior quench process:

1) Will provide maximum economic benefits by effectively reducing the loss of valuable products to the thermal reactions that occur after catalytic cracking is substantially completed.

2) Will have minimum adverse effects on operations.

3) Will minimally affect utility costs.

Although it is quite clear that a number of fluids could be used as quench, because the requirements of a quenching process are complex, the selection of a quench material and implementation of quenching are neither simple nor obvious. A fluid that is outstanding in one aspect may be unacceptable in another.

Figure 7:
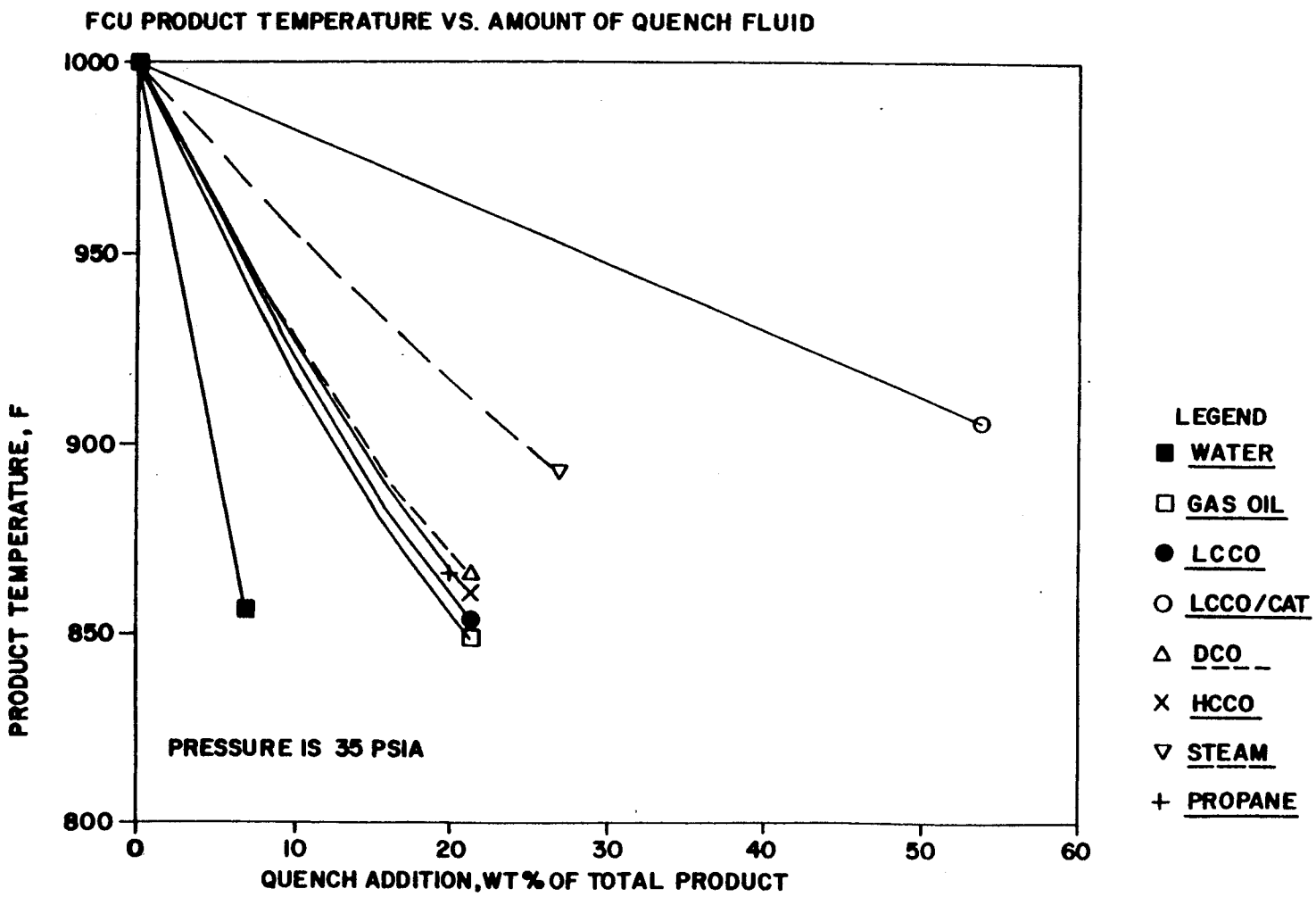
FIGS. 7 and 8 are charts of product temperature for various amounts of quenches.
Figure 8:
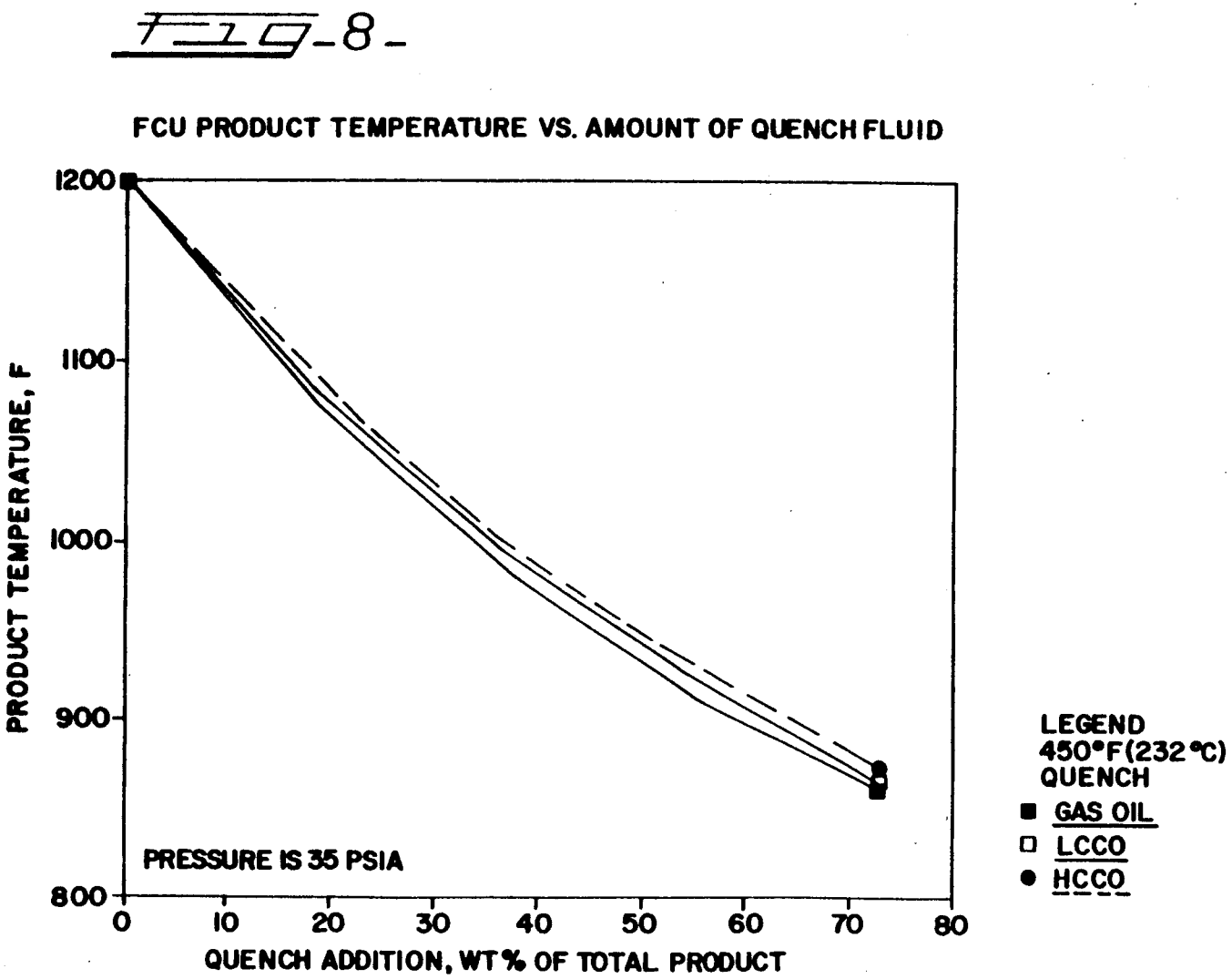

The quench fluid cools and dilutes the FCC riser products and so reduces the yield of thermal products. FIGS. 7 and 8 show, the ability of various quenches to cool the product stream, and the relative cooling capacities of different fluids. Quenched product temperature is plotted as a function of the amount of quench addition. The LCCO/CAT in FIG. 7 means that LCCO quench was injected into the oil product before the catalyst was grossly separated from the oil product. The quench addition, expressed as a percentage, is the ratio of the weight of quench fluid to the weight of the product stream. The heat capacity of the quench fluid and its heat of vaporization (if a liquid) influence the cooling capacity. Water is very effective and cools at 20° F. per 1 wt % addition. Hydrocarbons are also effective and provide cooling at approximately 7° F. per 1 wt % addition. Less effective is steam (4° F. per 1 wt %) because it is already vaporized. Cooling the products before removing catalyst requires tremendous amounts of quench fluid because the catalyst holds large quantities of heat and there is so much catalyst present (typically 6 times the weight of oil). Although water provides good cooling, it has drawbacks that offset this advantage.

TABLE B

| | Quench Molecular Wt. | Relative Thermal Crackability | Product Concentration | Quench Concentration | C2− Fuel Gas Reduction Wt. % |
|---|---|---|---|---|---|
| Water Hydrocarbons | 18 | 0.00 | 0.737 | 0.263 | 78.0 |
| Water Hydrocarbons | 106 | 0.36 | 0.846 | 0.154 | 69.4 |
| Water Hydrocarbons | 114 | 0.59 | 0.856 | 0.144 | 68.0 |
| Water Hydrocarbons | 130 | 1.37 | 0.871 | 0.129 | 64.4 |
| Water Hydrocarbons | 201 | 0.65 | 0.913 | 0.087 | 65.7 |
| Water Hydrocarbons | 216 | 1.06 | 0.918 | 0.082 | 64.0 |
| Water Hydrocarbons | 245 | 2.46 | 0.927 | 0.073 | 60.8 |
| Water Hydrocarbons | 339 | 1.05 | 0.946 | 0.054 | 63.1 |
| Water Hydrocarbons | 365 | 1.71 | 0.950 | 0.050 | 62.1 |
| Water Hydrocarbons | 414 | 3.96 | 0.956 | 0.044 | 59.1 |

Adding a quench fluid reduces the fuel gas by decreasing the temperature of the product diluting the concentration of riser products. The rate of thermal degradation of the riser products (and also the hydrocarbon quench) depends upon the temperature, the residence time in the system, the concentration of vapor, and the inherent reactivity (thermal crackability) of the material. Reducing the concentration of riser products slows the rate of degradation provided that the quench fluid itself has a lower thermal crackability than the riser product. Table B gives the relative molar concentrations of riser product initially at 1000° F. (538° C.) and quench fluid for various quench fluids of different molecular weights injected at a ratio of about 15% by weight of the product. In Table B and the following tables the C2-fuel gas reduction is relative to the instantaneous cooling of the hydrocarbon products from 1000° F. (538° C.) to 900° F. (482° C.) with a residence time of about 13 seconds. The quench fluids (injected as liquids) expand to different volumes depending on the molecular weights. The lowest molecular weights provide the maximum expansion and, therefore, the maximum dilution of the riser product. Table B also provides an estimate of the reduction in C2-fuel gas production based on laboratory tests and includes the relative thermal reactivity of the quench fluids. Quench fluids that have low molecular weights give the maximum reduction in C2-fuel gas production since C2-fuel provided measures the extent of thermal degradation, provided that the quench fluid itself has a low susceptibility to thermal cracking.

Stability of the quench is important. A quench material that is unstable will require excessive replacement and will itself contribute to the C2-yield. Table B includes the thermal stability of the various fluids. The thermal stability (crackability) was determined from laboratory tests of various quench fluids. The values in the table are relative to the thermal stability of heavy catalytic naphtha, which will have properties similar to riser products. Of course, the non-hydrocarbon, water, does not crack, so its performance establishes a target for the hydrocarbons. Hydrocarbons with low crackability give satisfactory performance.

Mixing time is also an important factor in quenching. When the quench fluid is injected into the hot product stream, the quench and product streams must mix as quickly as possible in order to get the maximum rate of cooling. Inefficient mixing of the two streams allows extra time for the thermal reactions to proceed. By using atomizing nozzles to inject the quench fluid, very small droplets are formed that disperse and vaporize quickly.

The effect of mixing time on the reduction in thermal products is indicated in Table C, based on laboratory results for LCCO quench:

TABLE C

Effects of Cooling Time on C2 Fuel Gas Reduction for LCCO Quench

| Product Temperature | Cooling Time sec | Wt % of Quench to Product | C2− Fuel Gas Reduction % |
|---|---|---|---|
| 1000° F. (538° C.) | 1 | 15 | 92.4 |
| 1000° F. (538° C.) | 5 | 15 | 64.0 |
| 1200° F. (649° C.) | 1 | 60 | 92.4 |
| 1200° F. (649° C.) | 5 | 60 | 68.5 |

Figure 9:
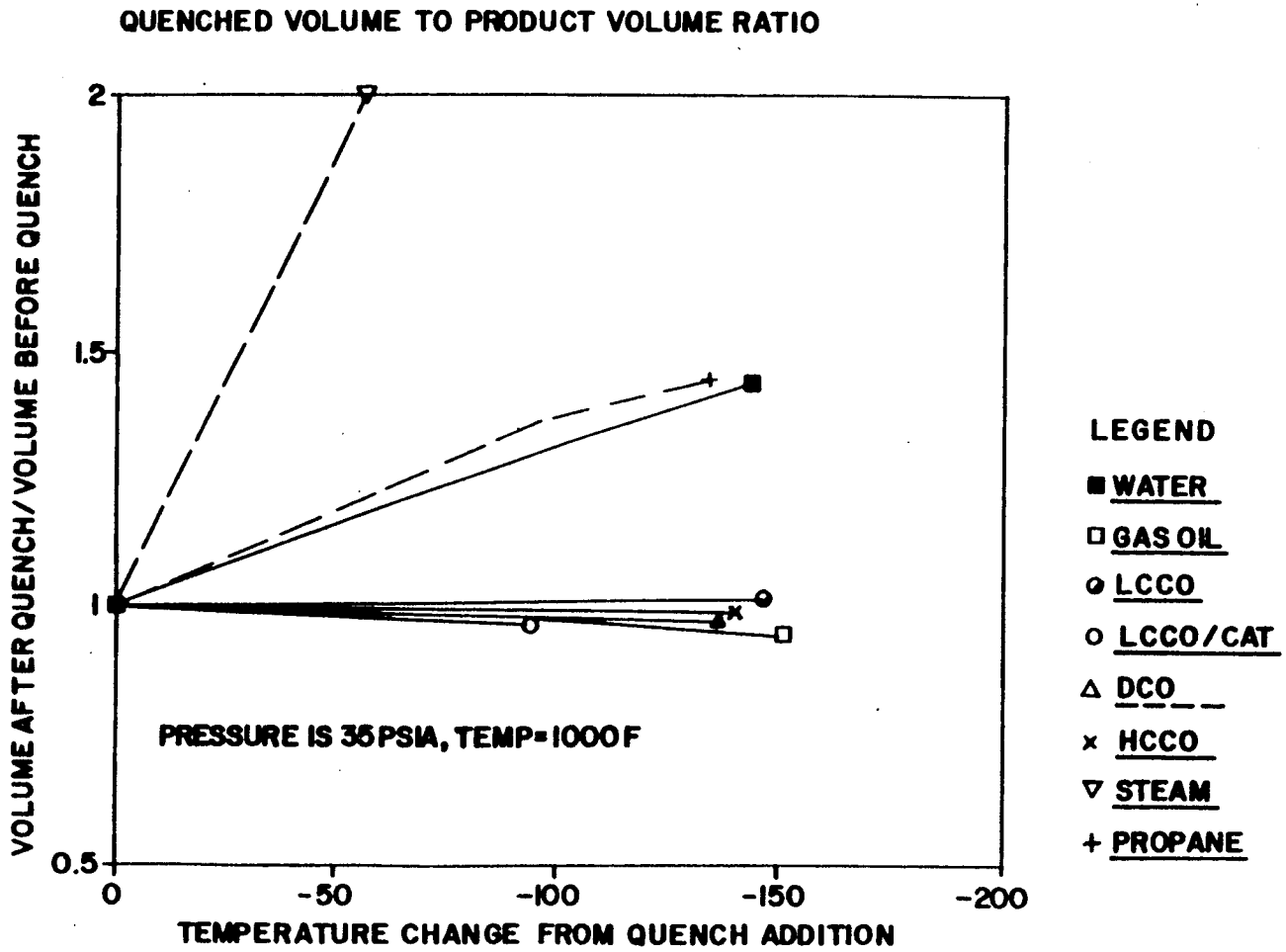
FIG. 9 is a chart of quench volume to product volume.

Vapor expansion is an important factor in selecting the proper quench. Vaporized quench enters the product recovery system and must be compatible with the process equipment and control. Improper selection of the quench fluid can lead to upsets in the riser discharge flow, in the separation of catalyst from the product vapors, and can cause interference with the efficient operation of the product fractionator. In order to minimize these disruptions, the quench fluid should give the minimum expansion to the vapor so that erratic and extreme pressure levels are avoided. FIG. 9 shows the ratio of the volume of the quenched product stream to the product stream alone as a function of temperature drop upon quenching for various quench fluids. The legend LCCO/CAT in FIG. 9 means that LCCO quench was injected into the oil product before the catalyst was grossly separated from the oil product. The gases, steam and propane, have the largest increases because substantial quantities must be added to cool the stream, and the low molecular weight gives large volumes of gas. Water also has a substantial vapor expansion. A water-quenched stream will have almost 20% more volume than the product stream alone. This magnitude of expansion can affect operations adversely and should be avoided. On the other hand, the liquid hydrocarbons exhibit a nearly neutral volume change. For the liquid hydrocarbons, the molecular weight is typically high enough so that the volume of gas is much less than for water. Also, the expansion of the hydrocarbon is offset by the contraction of the cooled product so that a nearly constant volumetric flow rate is achieved. This criterion is in contrast to the benefit of low molecular weight diluting the product vapor.

There are practical limits on the amount of quench that is used. The benefits diminish as the amount of quench increases. Also, the benefits are greatest the higher the riser product temperature. Table D illustrates this. Each pair of conditions in the table correspond to two levels of quench addition. At 1000° F. (538° C.) doubling the amount of quench reduces the C2-yield by only 45%. At 1200° F. (649° C.) increasing quench by a factor of 4 brings only a 30% improvement.

TABLE D

| Quench: | Pre-Quench Time, seconds | Pre-Quench Temp. | Post-Quench Time, seconds | Post Quench Temp. | Ratio of Quench to Feed % | C2-Fuel Gas Reduction, % |
|---|---|---|---|---|---|---|
| Water | 1 | 1000° F. (538° C.) | 12 | 950° F. (510° C.) | 2.33 | 71.2 |
| Water | 1 | 1000° F. (538° C.) | 12 | 900° F. (482° C.) | 5 | 99.3+ |
| LCCO | 1 | 1000° F. (538° C.) | 12 | 950° F. (510° C.) | 7 | 64.0 |
| LCCO | 1 | 1000° F. (538° C.) | 12 | 900° F. (482° C.) | 15 | 92.4 |
| LCCO | 5 | 1000° F. (538° C.) | 8 | 950° F. (510° C.) | 7 | 43.9 |
| LCCO | 5 | 1000° F. (538° C.) | 8 | 900° F. (482° C.) | 15 | 64.0 |
| Water | 1 | 1200° F. (649° C.) | 12 | 1100° F. (593° C.) | 5 | 74.3 |
| Water | 1 | 1200° F. (649° C.) | 12 | 900° F. (482° C.) | 20 | 97.5 |
| LCCO | 1 | 1200° F. (649° C.) | 12 | 1100° F. (593° C.) | 15 | 67.2 |
| LCCO | 1 | 1200° F. (649° C.) | 12 | 900° F. (482° C.) | 60 | 92.4 |
| LCCO | 5 | 1200° F. (649° C.) | 8 | 1100° F. (593° C.) | 15 | 45.8 |
| LCCO | 5 | 1200° F. (649° C.) | 8 | 900° F. (482° C.) | 60 | 68.5 |

Coking is another important criteria in determining the proper quench. A high tendency to form coke is detrimental to a quench fluid. Coke deposits can restrict process flows that could force a shutdown. Excessive coke in the regenerator could adversely affect the unit's heat balance and economics. On the other hand, a quench fluid that reduces coke by interaction with catalyst in the dilute zone of the disengager vessel improves the unit's coke selectivity and economics.

The use of quench increase utilities costs. A superior quench fluid minimizes those costs. Costs that are associated with the following: replacement of lost quench fluid; pumping the quench fluid; incomplete heat recovery and losses; water requirements for cooling and as boiler feed; and treatment of dirty process water.

Some hydrocarbon quench materials can thermally degrade. C2-fuel gas is produced by the degradation. Table E presents computer model predictions on the effects of various quench medium properties on the gross reduction in C2-. A quench fluid that degrades the products shows a lower C2-fuel gas reduction.

TABLE E

| Effects of Quench Material Properties on Predicted Performance | | | | | |
|---|---|---|---|---|---|
| Spec Gravity | Avg Boiling Pt ABP °F. | Molecular wt | Relative Thermal Crack-ability | Concen-tration of Quench | C2—Fuel Gas Reduc-tion, % |
| 0.825 | 300 | 130 | 1.38 | 0.129 | 91.3 |
| 0.825 | 575 | 245 | 2.46 | 0.073 | 89.5 |
| 0.825 | 800 | 414 | 4.00 | 0.044 | 88.6 |
| 0.93 | 300 | 114 | 0.59 | 0.144 | 94.5 |
| 0.93 | 575 | 216 | 1.06 | 0.082 | 92.4 |
| 0.93 | 800 | 365 | 1.72 | 0.050 | 91.4 |
| 0.99 | 300 | 106 | 0.37 | 0.154 | 95.6 |
| 0.99 | 575 | 201 | 0.66 | 0.087 | 93.4 |
| 0.99 | 800 | 339 | 1.06 | 0.054 | 92.4 |

There are not any or very little additional process water cost associated with the use of hydrocarbon fluids as quench material. Process water must be obtained when water is the quench material. The use of process water has additional cost. Water becomes contaminated when it goes through the process and must be treated to meet pollution control regulations.

Heat recovery is another important factor in selecting the proper quench. Substantial quantities of heat are absorbed by the quench material. This heat must be recoverable in a usable form if the quench process is to be practical. Generally, the higher the temperature at which heat is available, the more easily it can be recovered. Therefore, quench fluids that boil at higher temperatures will enable better heat recovery. In the FCC catalytic cracking unit, the heat recovery is integrated into the product fractionator system. Low temperature energy in the fractionator system is typically lost to cooling water. Energy in streams below approximately 212° F. (100° C.) to 350° F. (177° C.) is not recovered. Therefore, water is a poor quench medium from an energy recovery standpoint since it condenses at 212° F. (100° C.) at atmospheric pressure and since most of its energy is released when it condenses. A fluid that boils just below the target quench temperature will provide the maximum heat recovery.

In Table F, the enthalpies of some candidate quench fluids (LCCO, HCCO, HVGO, Gas, Oil, Water) are given that correspond to the temperatures in the table. The heats, Q1, Q2, Q3, Q4, are shown which are the heats absorbable above (a) 625° F. (329° C.), (b) between 625° F. (329° C.) and 475° F. (246° C.), (c) between 475° F. (246° C.) (c) and 325° F. (163° C.), (d) and between 325° F. (163° C.) and 60° F. (16° C.), respectively. Materials that absorb large amounts of heat at high temperatures (e.g., high Q1) are preferred, and those that absorb heat at low temperature (e.g., high Q4) are not preferred. For the materials in Table F, the order of preference as a quench medium is (1) HCCO, (2) LCCO, (3) Gas Oil, and lastly Water. The quenched product temperature and Q1 upper limit for each quench was at 900° F. (482° C.). The enthalpies were determined at a pressure of 20 psig (238 kPa).

TABLE F

Enthalpies of FCCU Product Quench Fluids and Available Heats

| | LCCO | | | HCCO | | | Feed Oil (HVGO) Gas Oil | | | Water | | |
|---|---|---|---|---|---|---|---|---|---|---|---|---|
| Temp. °F. | BTU/LB | | Available Heat BTU/LB | BTU/LB | | Available Heat BTU/LB | LCCO BTU/LB | | Available Heat BTU/LB | BTU/LB | | Available Heat BTU/LB |
| 1200 | 866.2 | | Maximum | 811.5 | | Maximum | 925.6 | | Maximum | 1639 | | Maximum |
| 1174 | 846.9 | ← | Product | 793.3 | ← | Product | 904.5 | ← | Product | 1626 | ← | Product |
| 1125 | 810.5 | | Temp. | 758.9 | | Temp. | 864.8 | | Temp. | 1600 | | Temp. |
| 1050 | 756.1 | | | 707.7 | | | 805.3 | | | 1560 | | |
| 975 | 703.3 | | | 657.8 | | | 747.2 | | | 1522 | | |
| 900 | 652.1 | | | 609.5 | | | 678.6 | | | 1483 | | |
| 825 | 602.7 | | | 562.9 | | | 566.8 | ← | Liquid | 1445 | | |
| 750 | 555.1 | | | 433.0 | ← | Liquid | 509.6 | | | 1408 | | |
| 675 | 508.4 | | | 384.0 | | | 454.5 | | | 1371 | | |
| 625 | 417.9 | Q1 = | 234.2 | 353.7 | Q1 = | 255.8 | 419.2 | Q1 = | 259.4 | 1347 | Q1 = | 136.15 |
| 600 | 372.6 | ← | Liquid | 338.6 | | | 401.5 | | | 1335 | | |
| 525 | 325.9 | | | 295.5 | | | 350.7 | | | 1299 | | |
| 475 | 296.4 | Q2 = | 121.4 | 268.3 | Q2 = | 85.4 | 318.4 | Q2 = | 100.8 | 1275 | Q2 = | 72 |
| 450 | 281.7 | | | 254.7 | | | 302.2 | | | 1263 | | |
| 375 | 239.9 | | | 216.4 | | | 256.3 | | | 1227 | | |
| 325 | 213.8 | Q3 = | 82.7 | 192.7 | Q3 = | 75.6 | 227.5 | Q3 = | 90.9 | 1203 | Q3 = | 72 |
| 300 | 200.7 | | | 180.9 | | | 213.1 | | | 1191 | | |
| 225 | 164.5 | | | 148.4 | | | 173.0 | | | 193 | | |
| 150 | 131.3 | | | 119.3 | | | 136.3 | | | 118 | | |
| 75 | 101.8 | | | 94.0 | | | 103.5 | | | 45 | ← | Liquid |
| 60 | 95.9 | Q4 = | 117.9 | 88.9 | Q4 = | 103.8 | 96.9 | Q4 = | 130.6 | 20 | Q4 = | 1175 |
| 32 | 84.9 | | | 79.5 | | | 84.7 | | | 0 | | |

QUENCH MATERIAL SELECTION

Some quench fluids are evaluated in Table G. Different refineries may use different quench materials to meet specific requirements or to take advantage of special opportunities. Among the fluids examined below, LCCO is best and HCCO is second best. Water has some serious shortcomings. The remaining materials have certain characteristics that can reduce their attractiveness as a quench fluid.

TABLE G

Evaluation of Candidate Quench Materials

| Quench | Water | Steam | Propane | HCN | LCCO | HCCO | DCO | (HVGO) GasOil | Kerosene | Hydro-treated GasOil | Hydro-treated LCCO |
|---|---|---|---|---|---|---|---|---|---|---|---|
| Cooling Capacity | E | P | P | A | A | A | A | A | A | A | A |
| Product Dilution | E | E | E | A | G | G | F | F | A | F | A |
| Stability | E | E | E | G | G | G | G | A | A | A | A |
| Volume Expansion | P | P | P | A | E | E | E | E | E | E | E |
| Coking Tendency | E | E | E | E | G | F | P | G | E | E | E |
| Pumping/ Transporting | G | F | F | A | A | A | A | A | A | A | A |
| Heat Recovery | P | P | P | F | G | E | E | G | G | G | G |
| Water Use | P | P | E | E | E | E | E | E | E | E | E |
| Waste Disposal | P | P | E | E | E | E | E | E | E | E | E |

Key:
P: Poor
F: Fair
A: Average
G: Good
E: Excellent

Among the many advantages of the novel catalytic cracking and quenching process are:

1. Enhanced product values and quality.
2. Greater yield of more valuable hydrocarbons.
3. Production of more naphtha and finished gasoline.
4. Higher throughput.
5. Better throughput and oxidation stability of product naphtha.
6. Decreased thermal cracking and product degradation thereby minimizing overcracking of gasoline into ethane and light fuel gas.
7. Lower pentadiene content in the naphtha product.
8. Less low value fuel gas production.
9. Increased octane number of naphtha and finished gasoline.
10. Economical
11. Efficient
12. Effective.

Although embodiments of the invention have been shown and described, it is to be understood that various modifications and substitutions, as well as rearrangements of process steps, can be made by those skilled in the art without departing from the novel spirit and scope of the invention.

What is claimed is:

1. A catalytic cracking unit, comprising:

a catalytic cracker reactor for producing a stream of catalytically cracked oil containing particulates of coked catalyst;

an external gross cut separator positioned externally downstream, outwardly of, and communicating with said catalytic cracker for making a gross cut separation of said coked catalyst particulates from said catalytically cracked oil;

a disengager comprising an upright disengaging vessel with at least one internal cyclone for removing a substantial amount of remaining coked catalyst particulates from said catalytically cracked oil;

a product stream line extending between, connecting and in fluid communication with said external gross cut separator and said disengager for passing said catalytically cracked oil from said external gross cut separator to said disengager; and a quench injector connected to and in fluid communication with said product stream line at a location between said gross cut separator and said disengaging vessel for injecting a quench into said catalytically cracked oil in said product stream line to substantially decrease thermal cracking of said catalytically cracked oil in said product stream line and said disengaging vessel.

2. A catalytic cracking unit in accordance with claim 1 wherein said catalytic cracker reactor comprises an upright elongated riser reactor and said quench injector is positioned in proximity to said external gross cut separator.

3. A catalytic cracking unit in accordance with claim 1 wherein said catalytic cracker reactor comprises a vessel providing a fluidized bed reactor.

4. A catalytic cracking unit in accordance with claim 1 wherein said gross cut separator comprises a cyclone.

5. A catalytic cracking unit, comprising:

an upright elongated fluidized catalytic cracker riser reactor for catalytically cracking feed oil in the presence of a cracking catalyst to produce an upgraded effluent product stream of catalytically cracked oil leaving coked catalyst, said riser reactor having an upper portion and a lower portion;

a gross cut inertia separator comprising an external rough cut cyclone connected to and communicating with said upper portion of said fluidized catalytic cracker riser reactor and being spaced outwardly from, positioned about and at a substantially similar elevation as said upper portion of said fluidized catalytic cracker riser reactor for making a gross separation of said coked catalyst from said catalytically cracked oil;

an upright disengaging vessel for substantially disengaging and separating a substantial amount of remaining coked catalyst from said catalytically cracked oil, said upright disengaging vessel being spaced from and positioned downstream of said external rough cut cyclone, said disengaging vessel having an upper dilute phase portion with at least one internal separator, a lower dense phase portion with a stripping section providing a stripper;

an oil product line extending between and connecting said external gross cut cyclone and said upper dilute phase portion of said upright disengaging vessel for passing catalytically cracked oil from said external rough cut cyclone to said disengaging vessel;

a spent catalyst line extending between and connecting said external rough cut cyclone and said dense phase portion of said disengaging vessel;

a regenerator comprising a regenerator vessel, an upright elongated lift pipe extending from said stripper to said regenerator vessel for transporting coked catalyst from said stripper to said regenerator vessel, an air injector communicating with said lift pipe for injecting air and facilitating combustion of said coked catalyst, and a regenerated catalyst line connected to said fluidized catalytic cracker riser reactor for conveying regenerated cracking catalyst to said fluidized catalytic cracker riser reactor; and a cycle oil quench injection line connected to and communicating with said oil product line for injecting a cycle oil selected from the group consisting of light catalytic cycle oil and heavy catalytic cycle oil, into said catalytically cracked oil in said oil product line after said catalytically cracked oil has exited said external rough cut cyclone downstream of said fluidized catalytic cracker riser reactor and has been grossly separated from said catalyst and before said catalytically cracked oil enters said disengaging vessel for enhancing the yield of naphtha and substantially decreasing thermal cracking of said product stream of oil in said oil product line and said disengaging vessel.

6. A catalyst cracking unit in accordance with claim 5 wherein said cycle oil quench injection line has a substantial vertical portion for injecting said cycle oil substantially vertically downwardly into said oil product line.

7. A catalytic cracking unit in accordance with claim 5 wherein said cycle oil quench line is positioned at an angle of inclination ranging from about 15 degrees to about 45 degrees relative to a vertical reference line for increasing mixing of said cycle oil with said catalytically cracked oil.

8. A catalytic cracking unit in accordance with claim 5 wherein:

said regenerator comprises an overhead regenerator positioned above said upright disengaging vessel; and said regenerated catalyst line includes an upright regenerated catalyst standpipe with an overhead withdrawal well.

9. A catalytic cracking unit in accordance with claim 5 wherein said cycle oil comprises light catalytic cycle oil; and said catalytic cracking unit comprises an FCC fractionator positioned downstream of said disengaging vessel for separating said catalytically cracked oil into streams of gases and oils including a stream of light catalytic cycle oil;

an effluent line connected to, extending between and in fluid communication with said upper portion of said disengaging vessel and said FCC fractionator for conveying said catalytically cracked oil from said disengaging vessel to said FCC fractionator; and a light catalytic cycle oil fractionator line extending from said FCC fractionator and communicating with said cycle oil quench injection line for recycling at least some of said light catalytic cycle oil from said FCC fractionator to said cycle oil quench injection line for injection into said catalytically cracked oil in said oil product line.

* * * * *

UNITED STATES PATENT OFFICE
CERTIFICATE OF CORRECTION

Patent No. 5,089,235 Dated February 18, 1992

Inventor(s) JOHN G. SCHWARTZ, WILLIAM F. HAUSCHILDT, GEORGE P. QUINN AND JOHN M. FORGAC It is certified that error appears in the above-identified patent and that said Letters Patent is hereby corrected as shown below:

| Column | Line | |
|---|---|---|
| 2 | 8 | "regenreators" should read -- regenerators -- |
| 2 | 42 | "less reative" should read -- less reactive-- |
| 6 | 30 | "cycline" should read -- cyclone |
| 8 | 1 | "cycline" should read -- cyclone -- |
| 12 | 4 | "rough out" should read -- rough cut -- |

Signed and Sealed this

Twelfth Day of October, 1993

*Attest:*

*Attesting Officer*

BRUCE LEHMAN

*Commissioner of Patents and Trademarks*